US010337680B1

(12) United States Patent
Gordin

(10) Patent No.: US 10,337,680 B1
(45) Date of Patent: Jul. 2, 2019

(54) METHOD FOR IMPROVED AERIAL LIGHTING

(71) Applicant: Musco Corporation, Oskaloosa, IA (US)

(72) Inventor: Myron Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 15 days.

(21) Appl. No.: 15/782,258

(22) Filed: Oct. 12, 2017

Related U.S. Application Data

(60) Provisional application No. 62/409,622, filed on Oct. 18, 2016.

(51) Int. Cl.

| | |
|---|---|
| ***H05B 37/02*** | (2006.01) |
| ***F21S 8/08*** | (2006.01) |
| ***F21V 21/116*** | (2006.01) |
| ***F21S 2/00*** | (2016.01) |
| ***F21V 7/09*** | (2006.01) |
| *F21W 131/105* | (2006.01) |
| *F21W 131/40* | (2006.01) |

(52) U.S. Cl.
CPC ..... *F21S 8/081* (2013.01); *F21S 2/00* (2013.01); *F21V 7/09* (2013.01); *F21V 21/116* (2013.01); *A63C 2203/14* (2013.01); *F21W 2131/105* (2013.01); *F21W 2131/40* (2013.01)

(58) Field of Classification Search
CPC ..... H05B 37/0218; H05B 37/0281; F21V 23/0464
See application file for complete search history.

(56) References Cited

U.S. PATENT DOCUMENTS

| | | | | |
|---|---|---|---|---|
| 4,272,799 | A | 5/1981 | Downing | |
| 7,976,198 | B1 | 7/2011 | Gordin | |
| 7,988,326 | B2 | 8/2011 | Gordin | |
| 8,523,397 | B1 | 9/2013 | Gordin | |
| 9,402,292 | B1 | 7/2016 | Gordin et al. | |
| 2006/0181882 | A1 | 8/2006 | Gordin et al. | |
| 2014/0340889 | A1 | 11/2014 | Gordin | |
| 2015/0334807 | A1* | 11/2015 | Gordin | H05B 37/0218 315/152 |

FOREIGN PATENT DOCUMENTS

JP 06084403 A 3/1994

OTHER PUBLICATIONS

Illuminating Engineering Society of North America, IES standard RP-6-15 pp. 31-33, May 16, 2011, Illuminating Engineering Society of North America, New York.
Clear, R.D., Discomfort glare: What do we actually know?, Lighting Research Technologies, 2012; 0:1-18.
English translation of cited JP06084403.
Unpublished U.S. Appl. No. 62/515,832.
Unpublished U.S. Appl. No. 15/702,974.

* cited by examiner

*Primary Examiner* — Joseph L Williams
(74) *Attorney, Agent, or Firm* — Jessica R. Boer

(57) ABSTRACT

Discussed herein is a new way to light baseball fields or other target areas (e.g., target areas including a plane and an aerial space) according to accepted standards or desired levels which provides both target area lighting and uplighting and in a manner that reduces or eliminates glare for certain playing positions while maintaining lighting levels across both the target area and the aerial space above the target area without necessitating the use of low-mounted uplights.

20 Claims, 19 Drawing Sheets

METHOD FOR IMPROVED AERIAL LIGHTING

CROSS-REFERENCE TO RELATED APPLICATIONS

This application claims priority under 35 U.S.C. § 119 to provisional U.S. Application Ser. No. 62/409,622, filed Oct. 18, 2016, hereby incorporated by reference in its entirety.

I. TECHNICAL FIELD OF INVENTION

The present invention generally relates to lighting of a target area, and issues that arise when the target area includes an aerial space. In the current state of the art, lighting for the aerial space sometimes must be provided from luminaire locations and aiming angles that can cause perceived glare by certain players who look directly or nearly directly into the light sources during play. In an effort to reduce perception of glare, aerial lighting intensity may be reduced, possibly to a point of being inadequate. Also, or instead, luminaires may be installed for aerial lighting in locations that are disadvantageous or create additional costs. The present invention specifically relates to providing improved aerial lighting with reduced perceived glare by directing light using improved aiming and cutoff techniques thereby avoiding said issues.

II. BACKGROUND OF THE INVENTION

Baseball lighting is a classic example of a lighting application prone to the aforementioned issues. Lighting baseball fields requires both illuminating the playing surface of the field (i.e. a plane) and also providing "uplighting" or "aerial lighting" (i.e. light to the 3D aerial space above and/or proximate the field). Field illumination is typically provided in accordance with at least a minimum accepted standard such as e.g. provided by Illuminating Engineering Society (IES) standard RP-6-15, and is well-known in the art. Illumination of targeted sky areas (i.e., uplighting) is just as needed, but less understood and with less regulation; U.S. Pat. Nos. 7,976,198, and 9,402,292 both of which are hereby incorporated by reference in their entirety discuss the necessity of consideration of aerial lighting levels and provide some examples of measurements of aerial lighting intensity as well as discussing some of the considerations that go into determining when uplight is needed, when glare may be perceived, how to adequately design a lighting system to provide uplight while mitigating glare, etc.

Oftentimes lighting that is otherwise satisfactory and meets illumination standards for field lighting can still pose problems for aerial lighting. As discussed in U.S. Pat. Nos. 7,976,198, and 9,402,292, lighting levels in the air may not be adequate; e.g. there may be a lack of direct illumination of the ball in the air, or insufficient contrast for playability. Or, lighting sources can cause glare and reduce playability for some of the players due to the mounting locations and aiming angles of the light sources. For example, as illustrated in FIG. 1C, a ball hit high in the air on a certain trajectory 180*a* by the batter 112 can be interposed at 183*a*, directly between an outfielder 140 and an intense source of light (e.g. 110, FIG. 1A) on a pole A1, such that the player experiences glare, even though the pole layout of FIG. 1C is in accordance with industry standards for pole placement. This glare can obscure the ball and reduce the player's ability to visually track it.

Various methods to improve aerial lighting have been proposed, including providing uplighting by using uplights such as 109 FIG. 1E, mounted low on existing poles 113 or other structures, separate from lighting arrays, typically mounted on the top of those same structures (see e.g. 110, FIGS. 1A, 1E). These uplights can be purpose-built or can be conventional lights which are adapted for uplighting, separate from the field lights. This is discussed both in U.S. Pat. No. 9,402,292 and in U.S. patent application Ser. No. 14/282,742, filed May 20, 2014, which is hereby incorporated by reference in its entirety. However, some locations such as major league baseball fields typically do not allow the use of lighting poles or other mounting structures which are between spectators and the playing field such as would be required for low-mounted uplights. This precludes the use of low-mounted uplights for these venues and therefore requires a different approach to reducing glare for certain players and situations. Also, even in locations where lighting poles are allowed between spectators and the field, low-mounted uplights may still not be desired for aesthetic or practical reasons; for example in retrofit lighting applications, low-mounted lighting might not be adaptable to the existing poles. So methods of lighting relying on low-mounted lighting are often not desired or practical; thus, it is apparent that a lighting method that provides for improved uplighting without using low-mounted uplights is needed in the art.

Thus there is room for improvement in the art.

III. SUMMARY OF THE INVENTION

Various methods to improve aerial lighting have been proposed over the years, including providing uplighting by using low-mounted uplights on existing poles; however, some venues (such as e.g. major league and minor league baseball fields), typically mount lights on support structures above or behind spectator seating and do not allow the use of lighting poles or other mounting structures which are between spectators and the playing field such as would be required for low-mounted uplights. This precludes the use of low-mounted uplights for these venues and therefore requires a different approach to reducing glare for certain players and situations. Also, low-mounted uplights may not be desired for aesthetic or practical reasons. Thus, it is apparent that a lighting method that provides for lighting the aerial space above and/or near a plane (e.g. a baseball field) without using low-mounted uplights is needed in the art.

It is therefore a principle object, feature, advantage, or aspect of the present invention to improve over the state of the art and/or address problems, issues, or deficiencies in the art.

A method is envisioned for control of lighting to improve playability (i.e. the ability to play optimally without hindrances or distractions from the lighting system) comprising preventing, reducing, or limiting lighting glare perceived by players in certain positions; using one or more lighting arrays comprising directed light sources for illumination patterns which may cut off below or above a player or position, or which may be separated by an intermediate non-illuminated area which may be part of upper and lower patterns separated by a vertical distance/angular space, or left and right patterns separated by a horizontal distance/angular space, or some combination thereof.

A method is further envisioned for lighting a sports field to an accepted standard for illumination including illumination of the playing field and any associated areas (e.g. the first few rows of spectator seating), and including lighting the aerial space above and/or near the field to an acceptable level (which provides both sufficient illumination of the ball and sufficient contrast of the ball with its background as viewed by a player on the field) comprising identifying one or more participants in a position on or near the field; identifying critical or important directions of sight by said one or more participants; identifying a lighting source, such as LED luminaires, in the sighting direction of one or more participants; and directing lighting to provide cutoff of visibility of the light source (such as e.g. the LEDs contained in an LED luminaire or reflected or diffused light therefrom) from the one or more participants to reduce or eliminate perceived glare from the field of vision of said participant(s) while performing a task that is important to the play of the game (such as e.g. a right- or left-fielder or center fielder visually tracking a ball batted into the air) while lighting for said sports field remains acceptable according to an accepted standard for illumination.

These and other objects, features, advantages, or aspects of the present invention will become more apparent with reference to the accompanying specification and claims.

IV. BRIEF DESCRIPTION OF THE DRAWINGS

From time-to-time in this description reference will be taken to the drawings which are identified by figure number and are summarized below.

Figure 7:
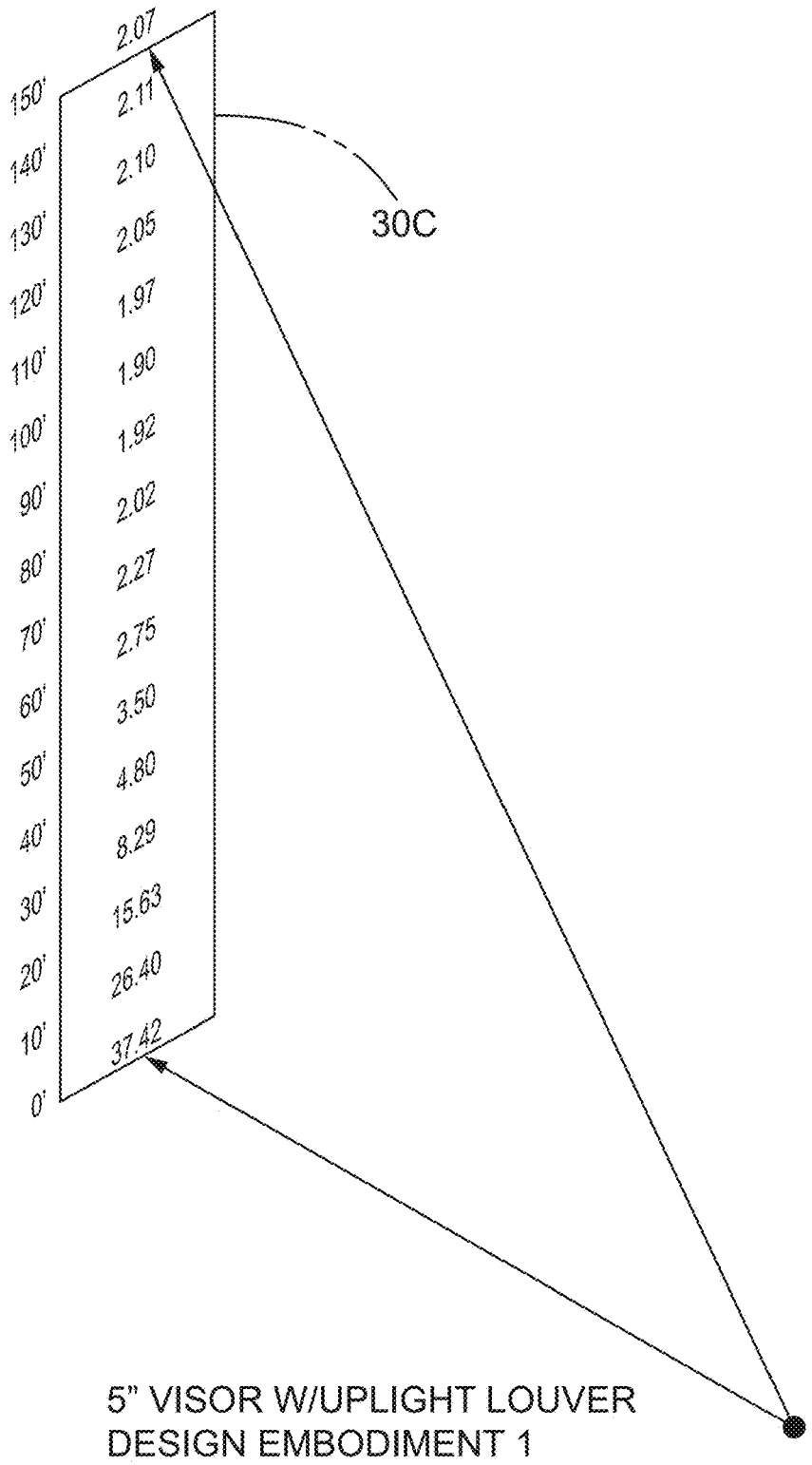

FIG. 7 is a reproduction of FIG. 3C from U.S. Pat. No. 7,976,198 which illustrates an example of aerial illumination levels in footcandles at various heights that are considered desirable for at least some lighting applications.

Figure 2A:
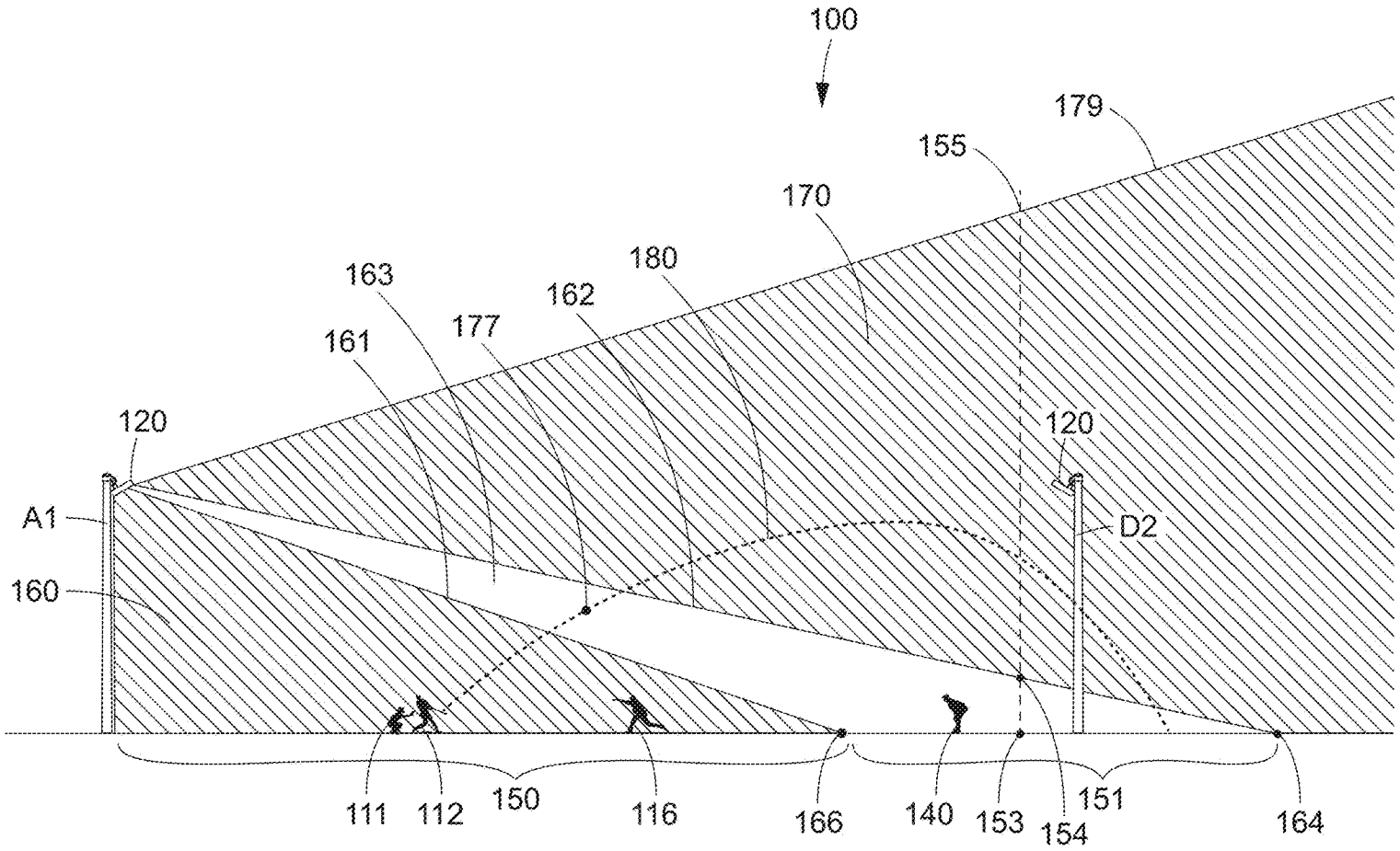
FIGS. 2A and 3A illustrate a baseball field in side views illuminated according to certain aspects of the invention.
Figure 3A:
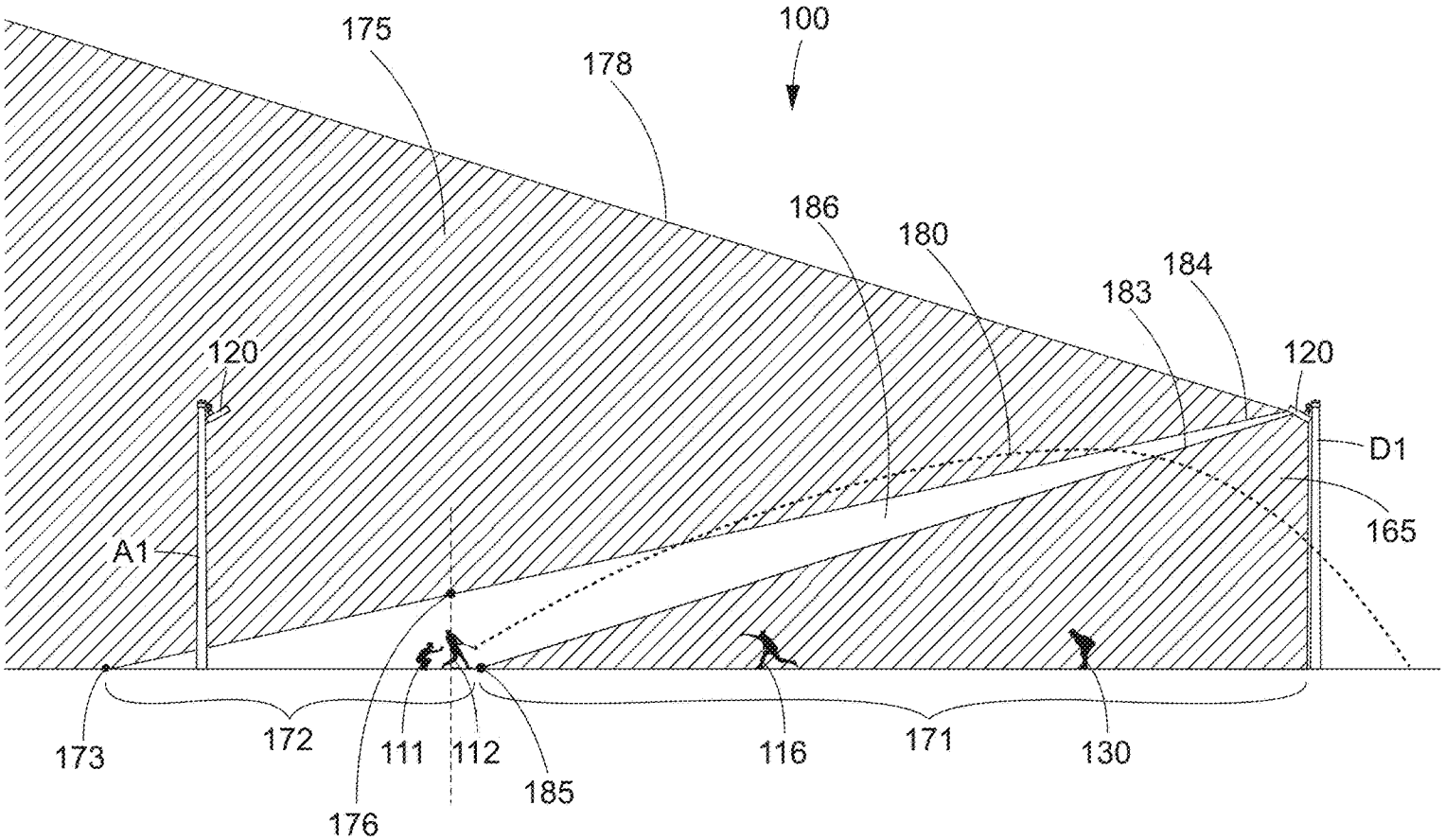
Figure 8:
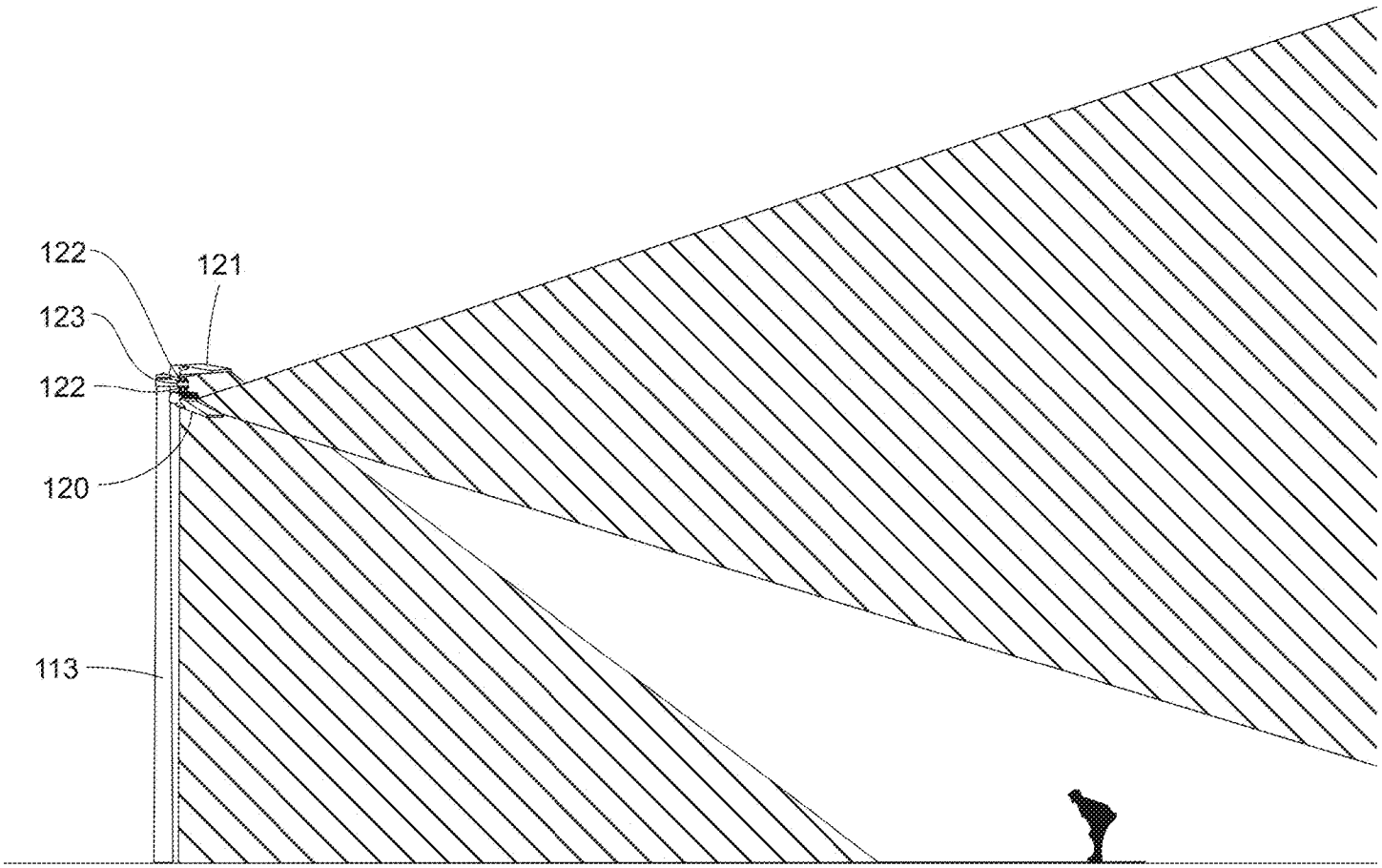

FIG. 8 illustrates one possible method of producing horizontal cutoff as in, e.g. FIGS. 2A and 3A, according to aspects of the present invention using two fixtures of the type discussed in incorporated by reference U.S. patent application Ser. No. 15/782,039.

Figure 4A:
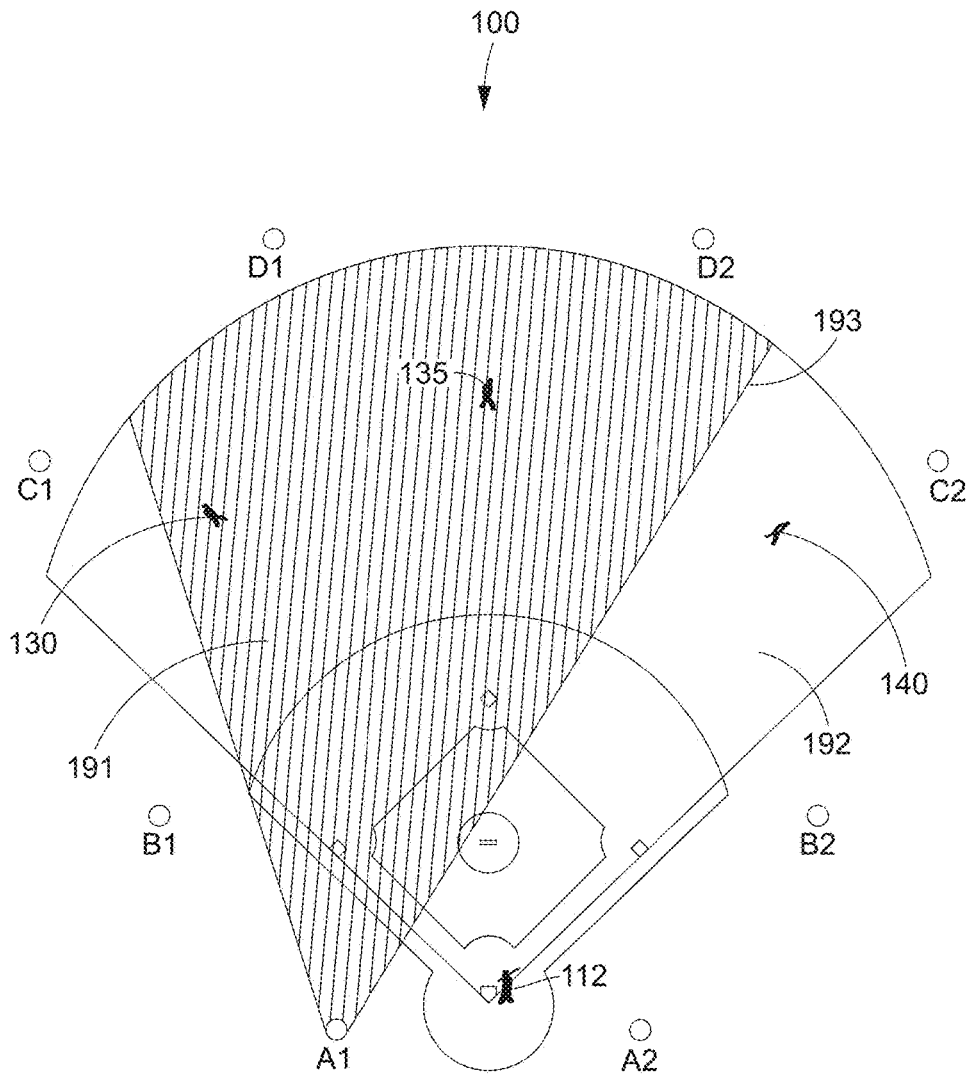
FIGS. 4A-4B illustrate a baseball field in plan views illuminated according to additional aspects of the invention.
Figure 4B:
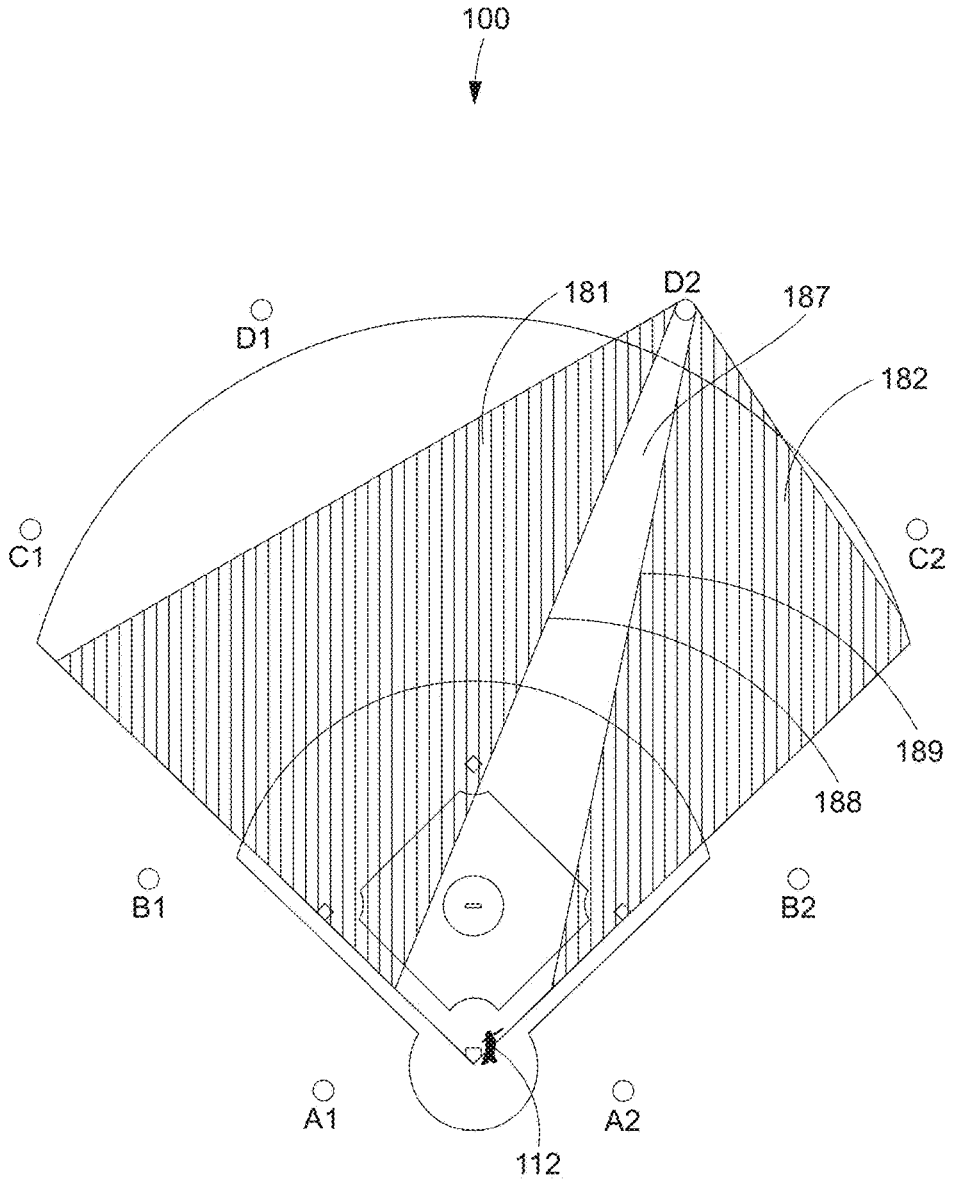
Figure 9:
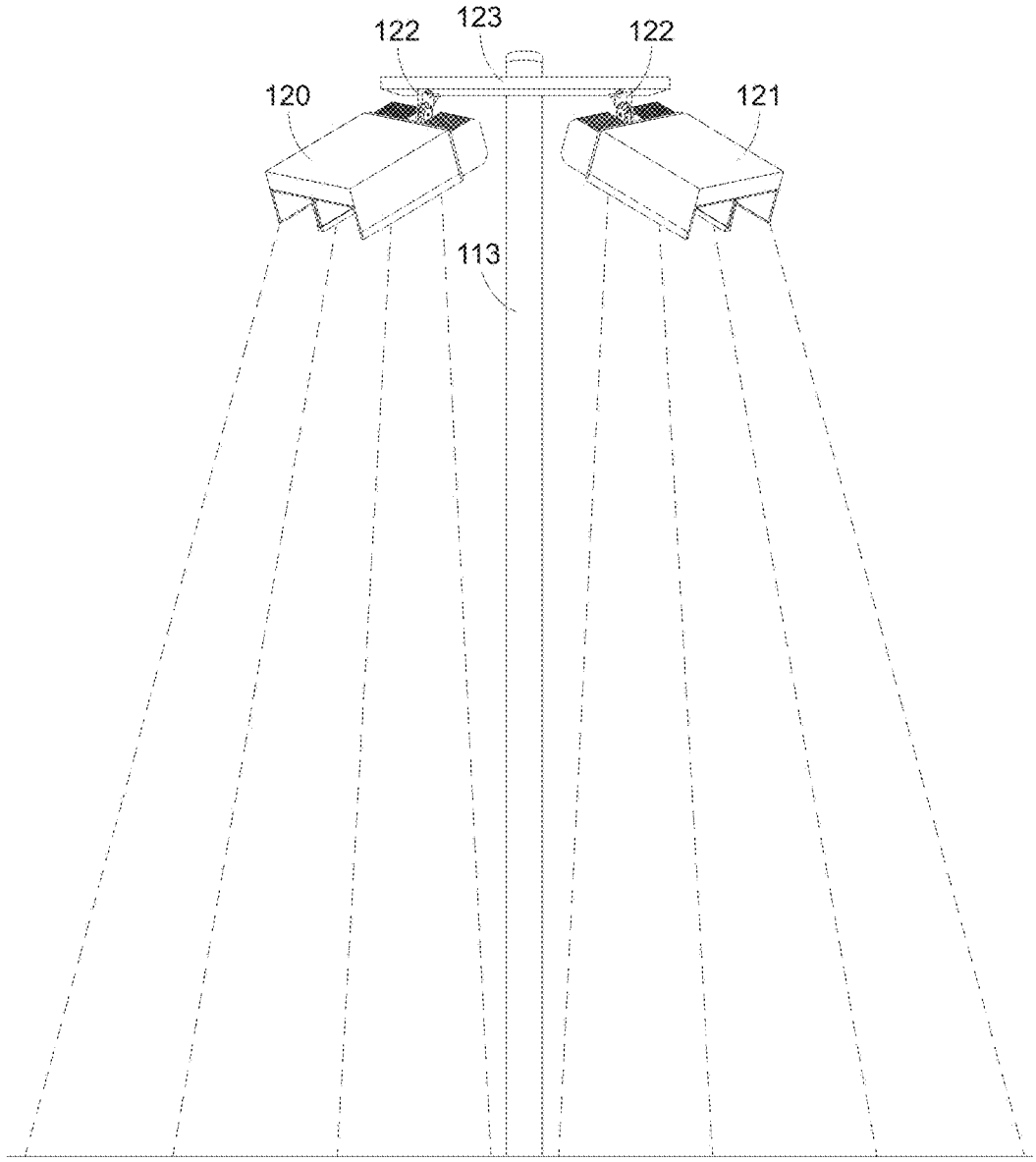

FIG. 9 illustrates one possible method of producing vertical cutoff as in, e.g. FIG. 4B, according to aspects of the present invention using two fixtures of the type discussed in incorporated by reference provisional U.S. Patent Application Ser. No. 62/515,832.

V. DETAILED DESCRIPTION OF EXEMPLARY EMBODIMENTS

A. Overview

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Terminology

Regarding terminology, unless specifically limited by context to e.g. an individual light-emitting component such as an LED or group of LEDs, the terms "light source(s)", "lighting fixture(s)", "fixtures", or "luminaire(s)" may refer to any of an LED or group of LEDs or other light emitting apparatus, a single fixture or multiple fixtures or luminaires, or even two one or more divisions of the lighting sources within a single fixture into separate sub-sources.

Also regarding terminology, the terms "uplight"/"aerial light" or "uplighting"/"aerial lighting" will be used to indicate light that illuminates particularly the aerial space (e.g., a 3D space) above a plane (e.g., a 2D plane) such as illuminating the aerial space above the plane of a baseball field. It should be noted that "uplight" or "aerial light" as used throughout the present document can result not only from light directed upwardly from low-mounted luminaires, but also light directed in a useful direction that might be up, horizontally, or down, from a luminaire mounted at some height, potentially a very high height, above a plane. Again, unless specifically noted, "uplight"/"aerial light" or "uplighting"/"aerial lighting" does not particularly refer to the direction which the light travels or the orientation of the luminaire. Rather, it refers to the light illuminating the aerial space through which e.g. a baseball travels above a baseball field. Also, it should be noted that while desired lighting levels for uplighting can vary, relative guidelines are available—see, for example, aforementioned U.S. Pat. No. 7,976,198 (FIG. 3C of which is included herein as FIG. 7). As can be seen from FIG. 7, aerial illumination levels in footcandles at various heights which are considered desirable for at least some locations and lighting applications are illustrated, though the invention is not limited to such.

It should be further understood that an uplight or aerial light need not be entirely devoted to lighting the aerial space above a target area. So for the example of a baseball field, an uplight that directs some portion of the light emitted therefrom downwardly towards the target area and directs some portion of the light emitted therefrom into the aerial space and potentially away from the target area is equally considered an uplight (with regard to the light illuminating the aerial space) as compared to a lighting fixture which directs all of the light emitted therefrom upwardly and away from the target area—regardless of mounting height or location of the luminaire relative the target area. Either type of uplight fixture could be used alone or in combination to produce a composite beam pattern in accordance with the methods discussed herein and, more broadly, with aspects according to the present invention.

Also regarding terminology, the terms "horizontal cutoff" and "vertical cutoff" will be used. It should be noted that by the term "horizontal cutoff" is meant a cutting off of light striking the field essentially along a line that is parallel to the horizon along a plane such that, for example, a player moving towards a light source from the outfield into the infield would cross the cutoff line and would move from an area NOT being illuminated by the luminaire and move into an area that is being illuminated by the luminaire. Further, by the term "vertical cutoff" is meant, for a player facing a light source, a cutting off of light along a plane that is more or less vertical such that, for example, a player moving from right field into center field would pass through the cutoff plane of light from the A1 pole and would move from an area NOT being illuminated by the luminaire into an area that is being illuminated by the luminaire. It should also be noted that the term "cutoff" (regardless of horizontal or vertical) refers to the concept which is well-known in the industry wherein light from a light source transitions from some light value to zero perceivable light value past a "cutoff" point or line projected onto a plane. This transition may be gradual, over many degrees, or it may be sharp, over a span of 10 degrees, 5 degrees, or even less. Co-owned, co-pending U.S. patent application Ser. No. 15/782,039 incorporated by reference herein in its entirety describes one kind of luminaire having a sharp cut off that would work well for embodiments as described herein.

Finally, the term "glare" is used throughout; specifically onsite glare (i.e., glare as perceived by someone at the target area (e.g., a player) as opposed to someone outside the target area (e.g., nearby residents)). The subject of what glare is and the extent to which it may impact playability is much discussed in the industry, particularly with regards to what is known as "disability glare" and "discomfort glare"; however, it should be noted that a quantitative analysis of types and severity of glare under different viewing conditions need not be made to understand and benefit from aspects according to the present invention. "Perceived glare" is very easily discerned from the point of view of a player, insomuch that any view of a light source or a reflection of a light source (as opposed to diffused or indirect light, for example) is typically perceived as glare by a player on a field. So in general, while "reducing glare" as envisioned in this application could be measured quantitatively, its benefits will be appreciated by players as at least simply removing lighting sources from direct or reflected view under many conditions.

Issues in the Art

Figure 1A:
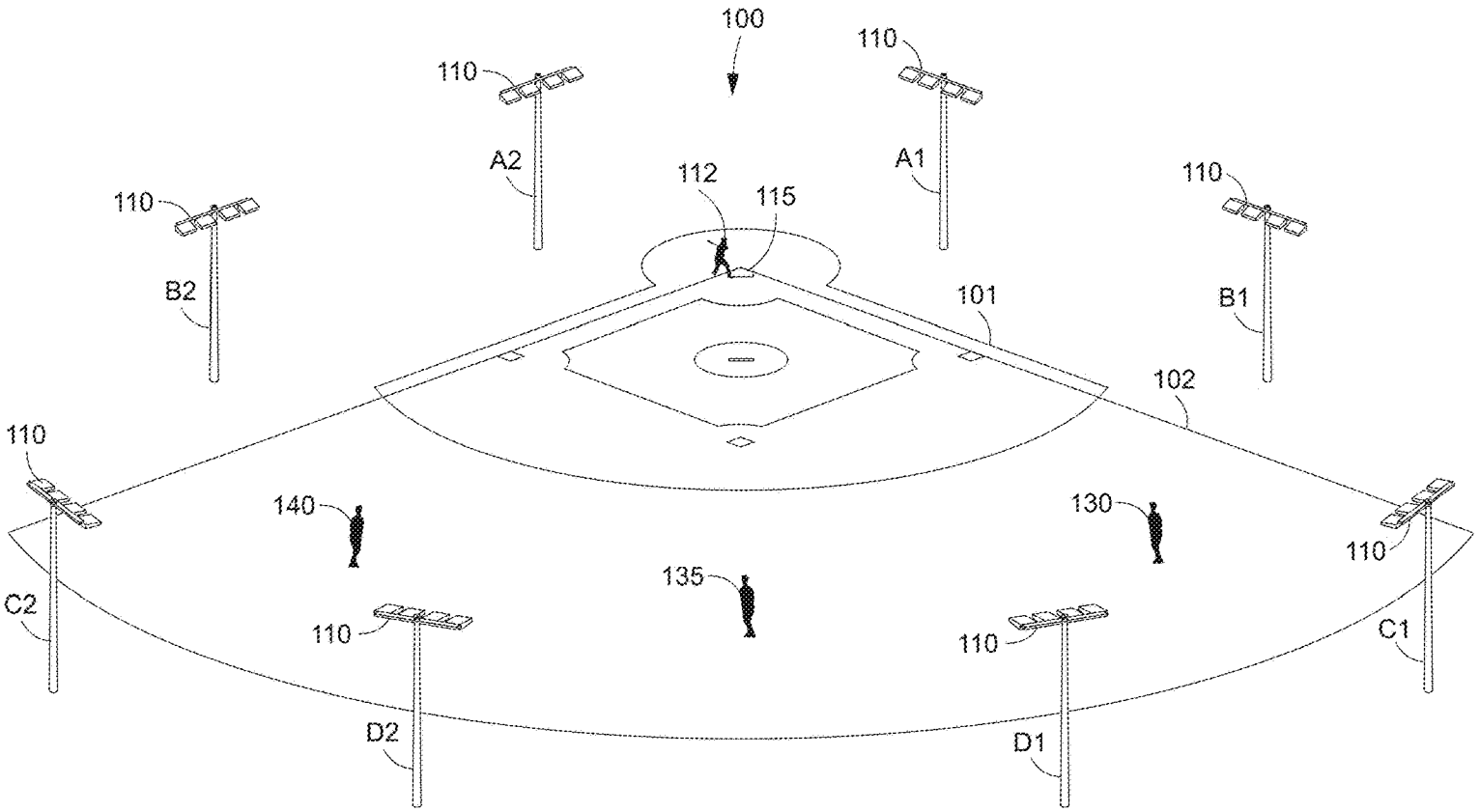
Prior Art Fig 1A
FIGS. 1A-1D illustrate a baseball field with typical locations for installing lights on poles or other structures high in the air according to existing art.
Figure 1B:
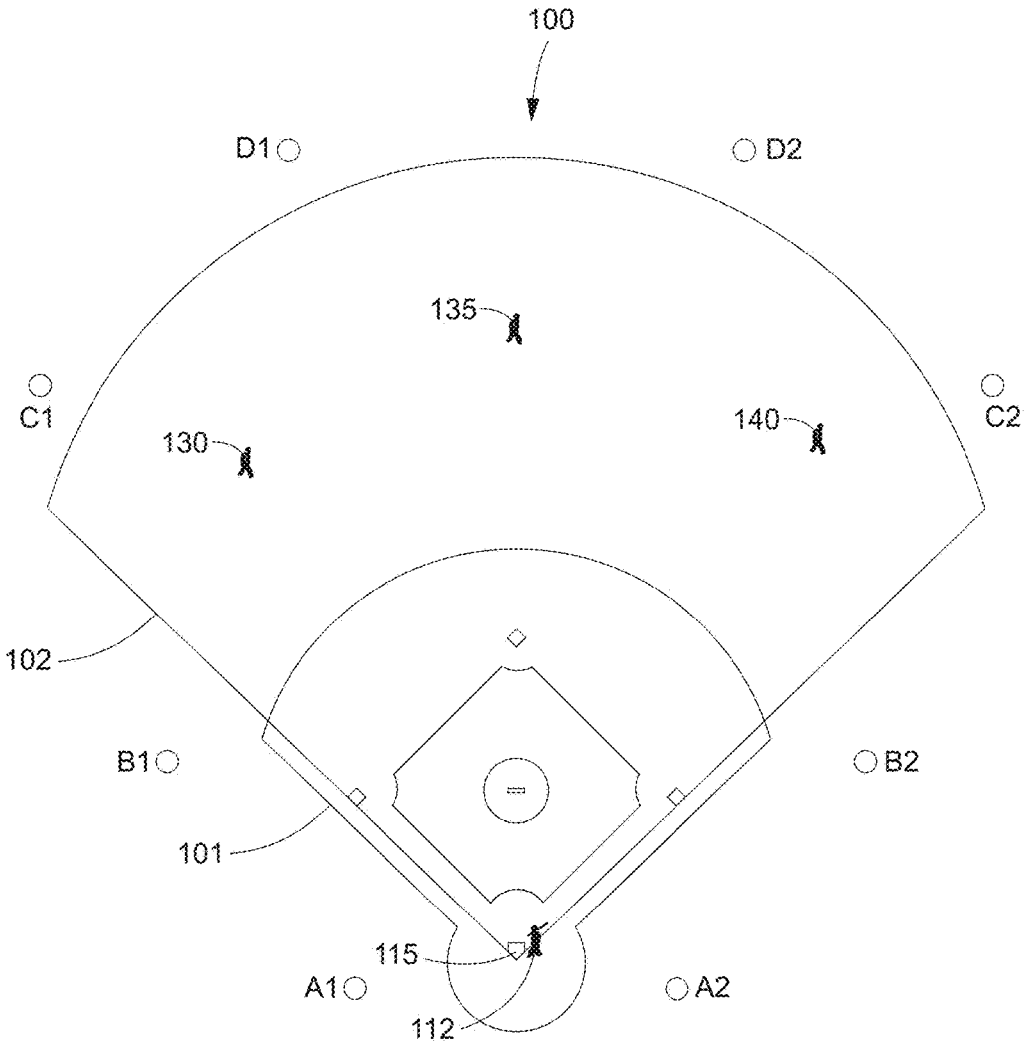
Prior Art Fig 1B

FIGS. 1A-1B depict a typical baseball field 100 illuminated using eight poles. A batter 112 at home plate 115, left fielder 130, center fielder 135, and right fielder 140 are also shown. LED luminaire arrays 110 on poles A1, B1, C1, and D1 on the left field side, and similar arrays 110 on poles A2, B2, C2, and D2 on the right field side, typically provide primary illumination to the infield 101 and the outfield 102. Said luminaires also provide illumination to the aerial space above the infield and outfield such that a ball hit by the batter high into the air will be illuminated for the benefit of players, particularly including the left and right field outfielders 130 and 140.

Figure 1C:
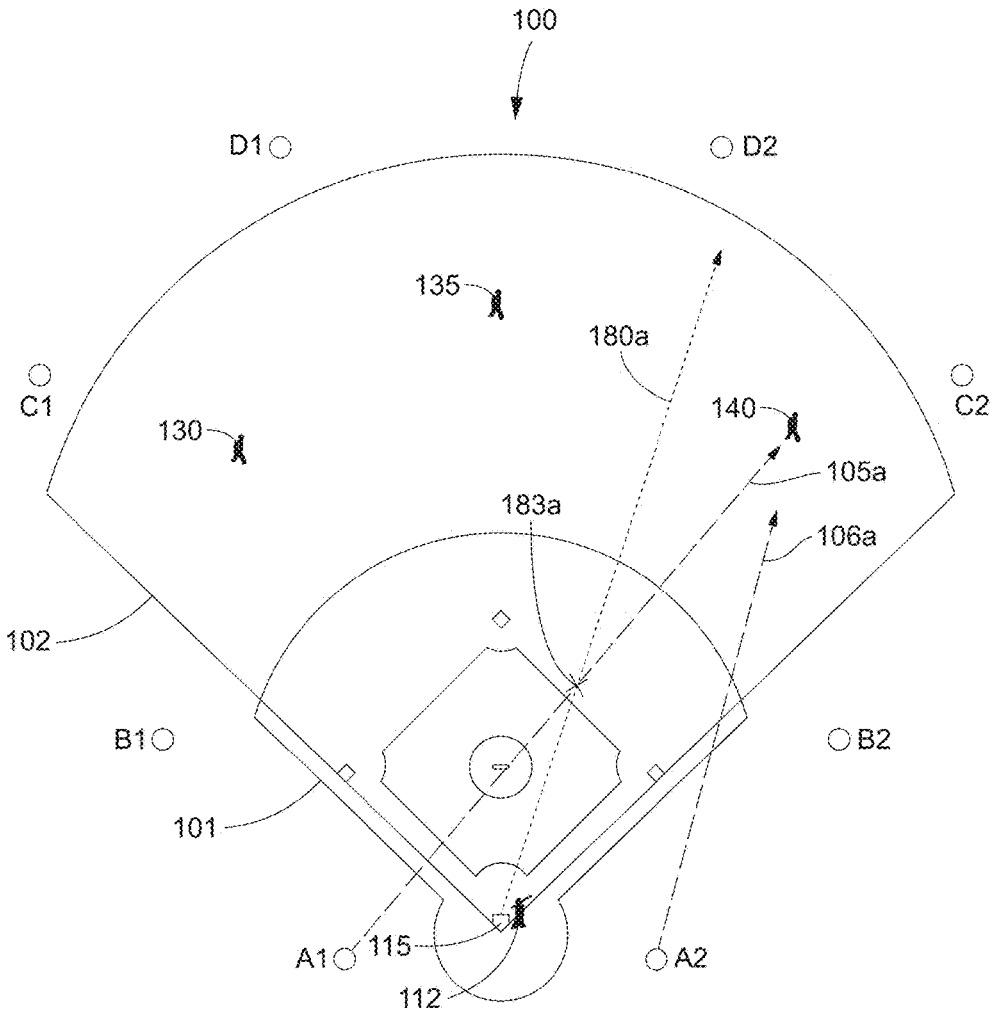
Prior Art Fig 1C
Figure 1D:
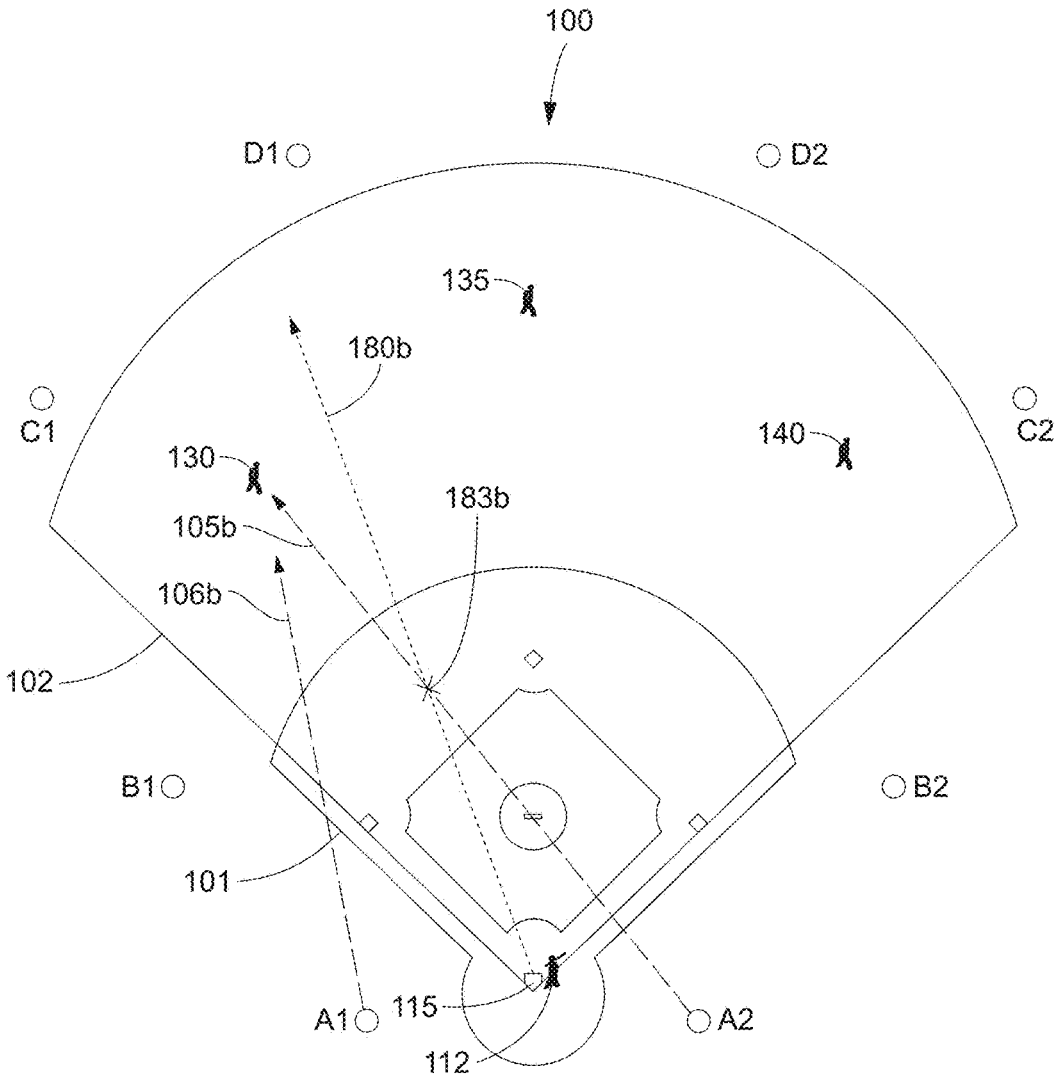
Prior Art Fig 1D

FIG. 1C illustrates how some of the light from poles A1 and A2 affects right fielder 140 in a typical lighting arrangement according to existing art. Line 180*a* shows an overhead view of a possible trajectory of a ball batted by batter 112. In order to track the batted ball, right fielder 140 has to look nearly directly at pole A1. The vertical plane through pole A1 and the right fielder along line 105*a* is crossed by the ball at point 183*a*. For some possible ball paths, the vertical height of the ball at point 183*a* will put it directly in front of the luminaire 110 on pole A1. The right fielder at that point will likely perceive glare, which will reduce his ability to track the ball, which is considered an undesirable effect. Note that the light along line 106*a* from pole A2 to the right fielder is less in view for the fielder following the illustrated ball trajectory, so there is less likelihood of interference with the vision of the right fielder from light from pole A2; at least under these conditions. However, the situation would be mirrored for left fielder 130 and light from pole A2, as is illustrated in FIG. 1D. The left fielder would experience the same glare from pole A2 as a ball on trajectory 180*b* crosses the vertical plane along 105*b* through pole A2 and the left fielder at point 183*b* when at a certain height. Note again that the light along line 106*b* from pole A1 to the left fielder is less in view for the fielder following the illustrated ball trajectory, so there is less likelihood of interference with the vision of the left fielder from light from pole A1, at least under these conditions. Further, for center fielder 135, light from both A1 and A2 poles could be a source of glare according to existing art.

General Embodiment and Method

A method is envisioned providing lighting including target area (e.g., field) lighting and aerial lighting to e.g. sports fields such as baseball fields, which reduces perception of glare, such as e.g. disability and/or discomfort glare, for certain players such as batter, left and right fielders, and center fielder, while providing improved lighting for playability of a ball in the air compared to existing lighting systems by e.g. increasing illumination or increasing contrast against the background for the ball as perceived of by a player. This may be further understood as a method for lighting a sports field to an accepted or desired standard wherein the illumination is provided from an array of LEDs or other light sources mounted at or near the top of a pole or equivalent mounting structure such as e.g. 120 or 121, FIG. 1F, at a height of tens of feet, typically on the order of 70-120 feet. A lower illumination pattern includes a first set or subset of light directed to a target area on the field and which also illuminates a lower aerial zone above said target area but not an intermediate area above the lower aerial zone. An upper illumination pattern includes a second set or subset of light directed beyond a lower (horizontal) cutoff line (which illuminates an upper aerial zone above said target area but not said intermediate area), such that the source of illumination and/or reflections therefrom are not directly viewable by a player performing a task that is important to the play of the game, such as e.g. a right- or left-fielder tracking a ball batted into the air or a batter at home plate opposing the pitcher. Said upper and lower illumination patterns may be provided from single luminaires having upper and lower beam patterns, or may be provided by two or more luminaires, one having at least a lower beam pattern with an upper cutoff, and another having at least an upper beam pattern with a lower cutoff, or some combination thereof when applied to an entire field or lighting design.

A further method is envisioned wherein lighting as described above using light sources such as an LED array provides primary light directed to a target area on the field (i.e., a plane) and which also illuminates an aerial zone above said target area (i.e., a 3D space), and includes directed light sources for illumination patterns which are divided or constrained along a vertical plane. These illumination patterns create, by carefully cutting off light on one or both sides of a player position, an area that is not illuminated by the light source (normally considered likely to create a perception of glare for the player). This allows illumination in directions and from locations that might otherwise be undesirable using conventional wisdom since, according to aspects of the invention, the player is shielded from the perception of glare. These illumination patterns can be described as illuminating a "left side" or "right side" location relative the player position, or both left and right side locations relative the player position, but not directly at or above the player position. Alternatively, these illumination patterns can create light on only one side of the player position, e.g. on the "left side" or the "right side" with the area and corresponding aerial space containing the player position non-illuminated from said light sources. Note that for purposes of the present discussion and ease of description, attention will be given herein mostly to methods providing both left and right side illumination with an intermediate area non-illuminated by a particular light source, but methods providing only left or only right side illumination as just described are envisioned as well and may be appropriate for local conditions.

A further method is envisioned wherein a sports field is illuminated to an accepted or desired standard such as IES standard RP-6-15 including illumination of the playing field and any associated areas, and the aerial space above the playing field; and wherein one or more certain participants such as players, coaches, observers, or officials in a position on or near the field are identified; critical or important directions of sight by said one or more participants are identified; the lighting source(s), such as one or more LED luminaires, closest to the sighting direction of said one or more participants, are identified; and lighting from said light source(s) is directed to provide cutoff of visibility of the actual light source, such as e.g. the LEDs contained in an LED luminaire or reflected light therefrom, while still providing lighting for said sports field to said accepted standard for illumination.

A more specific exemplary embodiment, utilizing aspects of the generalized example described above, will now be described.

B. Exemplary Embodiment 1—Horizontal Cutoff

Figure 1E:
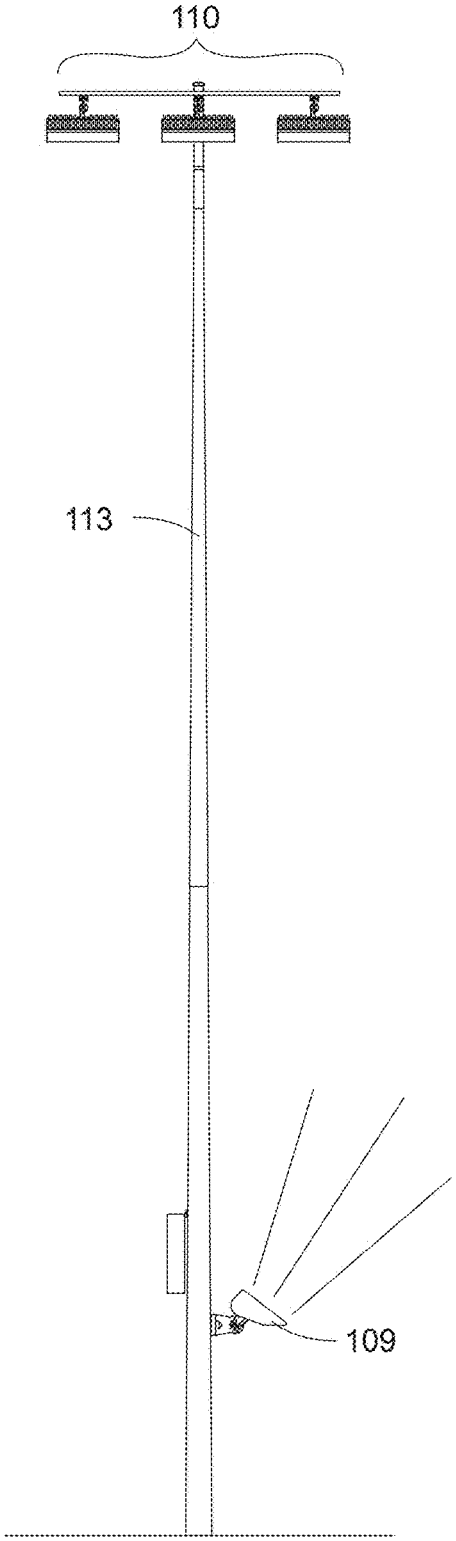
Prior Art Fig 1E
FIG. 1E illustrates a lighting system including apparatus to provide uplighting according to existing art.
Figure 1F:
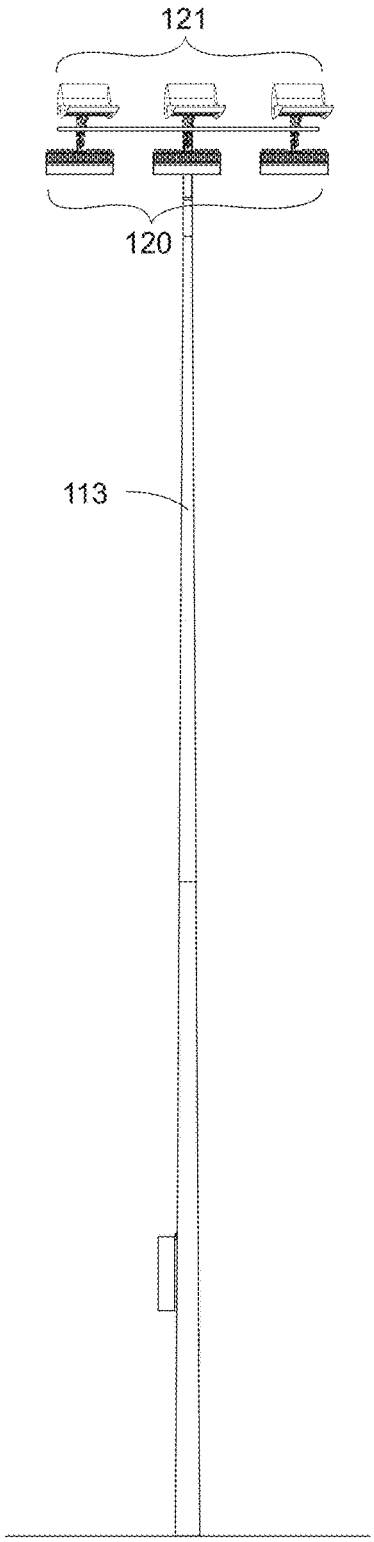
FIG. 1F illustrates a lighting system according to certain aspects of the invention.

An embodiment according to aspects of the invention comprises a method for lighting a sports field to an accepted or desired standard for illumination by providing a lighting design comprising directed light sources which provide a cutoff of visibility of the light sources, along one or two more-or-less horizontal planes which intersect the playing field such that light is provided on a portion of the field but is cut off from the area of the field where the fielder or other player is, and wherein the illumination is provided from an array of LEDs mounted at or near the top of a pole or equivalent mounting structure such as e.g. 120 or 121, FIG. 1F, at a height of tens of feet, typically on the order of 70-120 feet. Said illumination pattern comprises light directed to a target area on the field and which also illuminates a particular aerial zone above said target area but not the area in which a certain player ordinarily plays and reduces or eliminates glare from the light source for the player, while still providing lighting for said sports field to said accepted standard for illumination.

Horizontal Cutoff Lighting for Outfielders

Figure 2B:
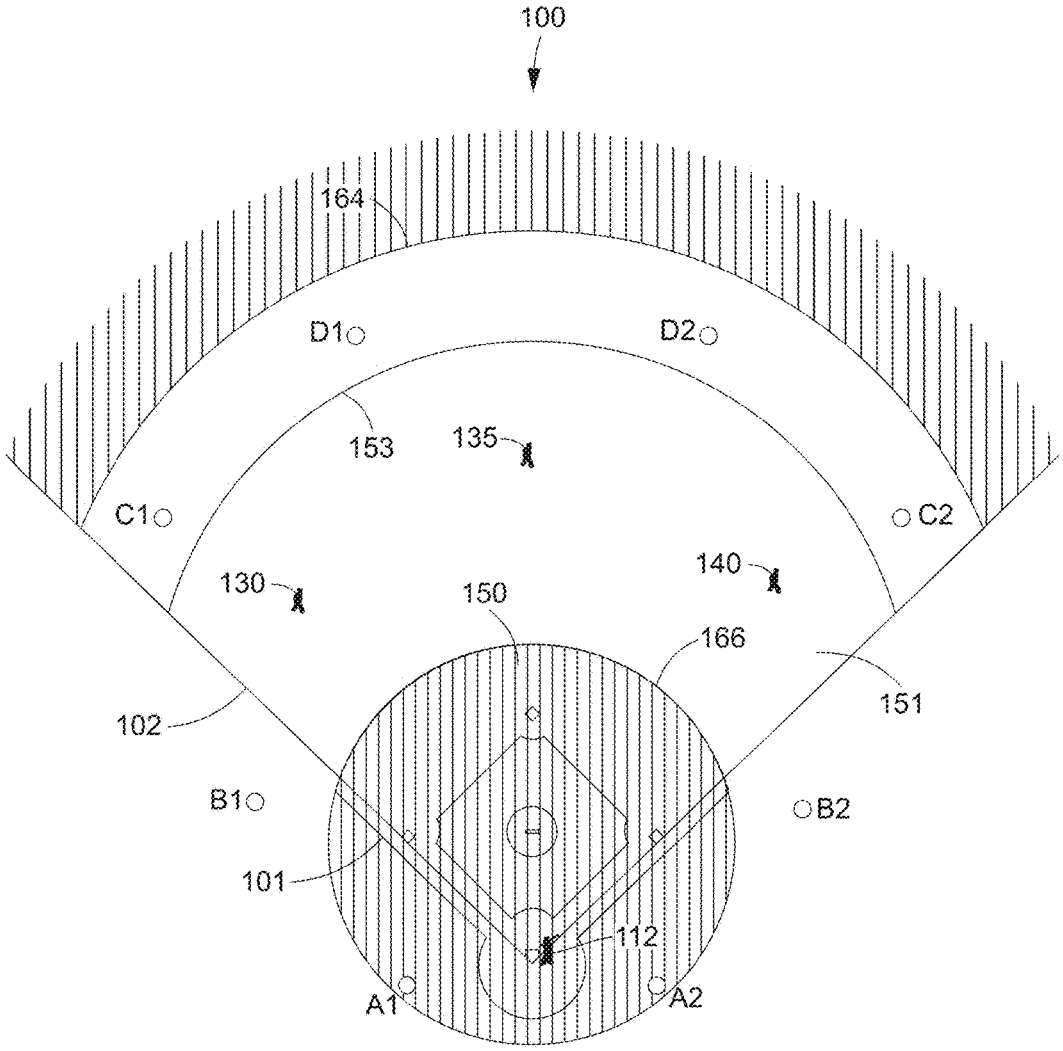
FIGS. 2B and 3B illustrate a baseball field in plan views illuminated according to certain aspects of the invention.
Figure 2C:
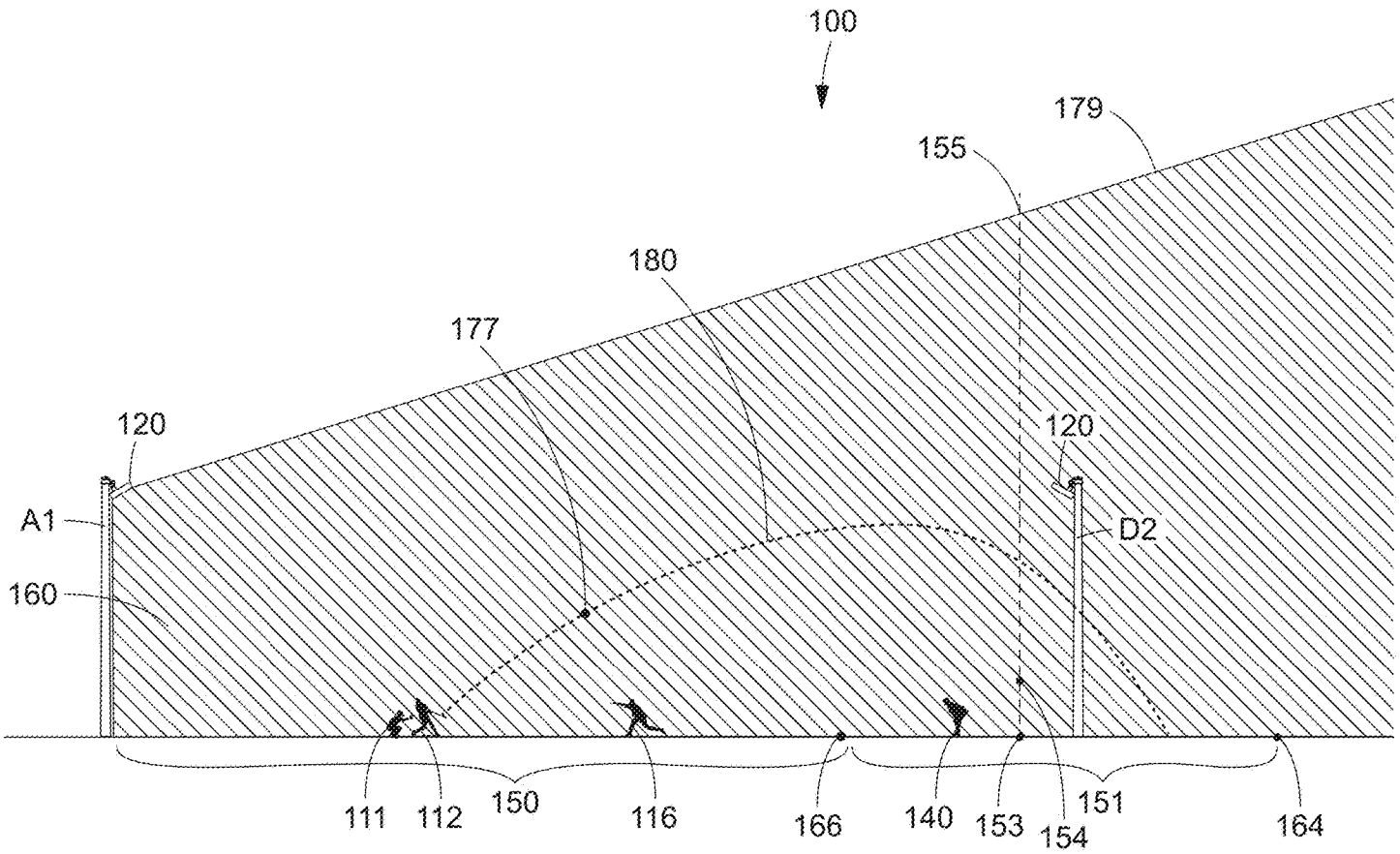
Prior Art Fig 2C
FIGS. 2C and 2D illustrate a baseball field in side views illuminated according to existing art, as perceived by certain players.
Figure 2D:
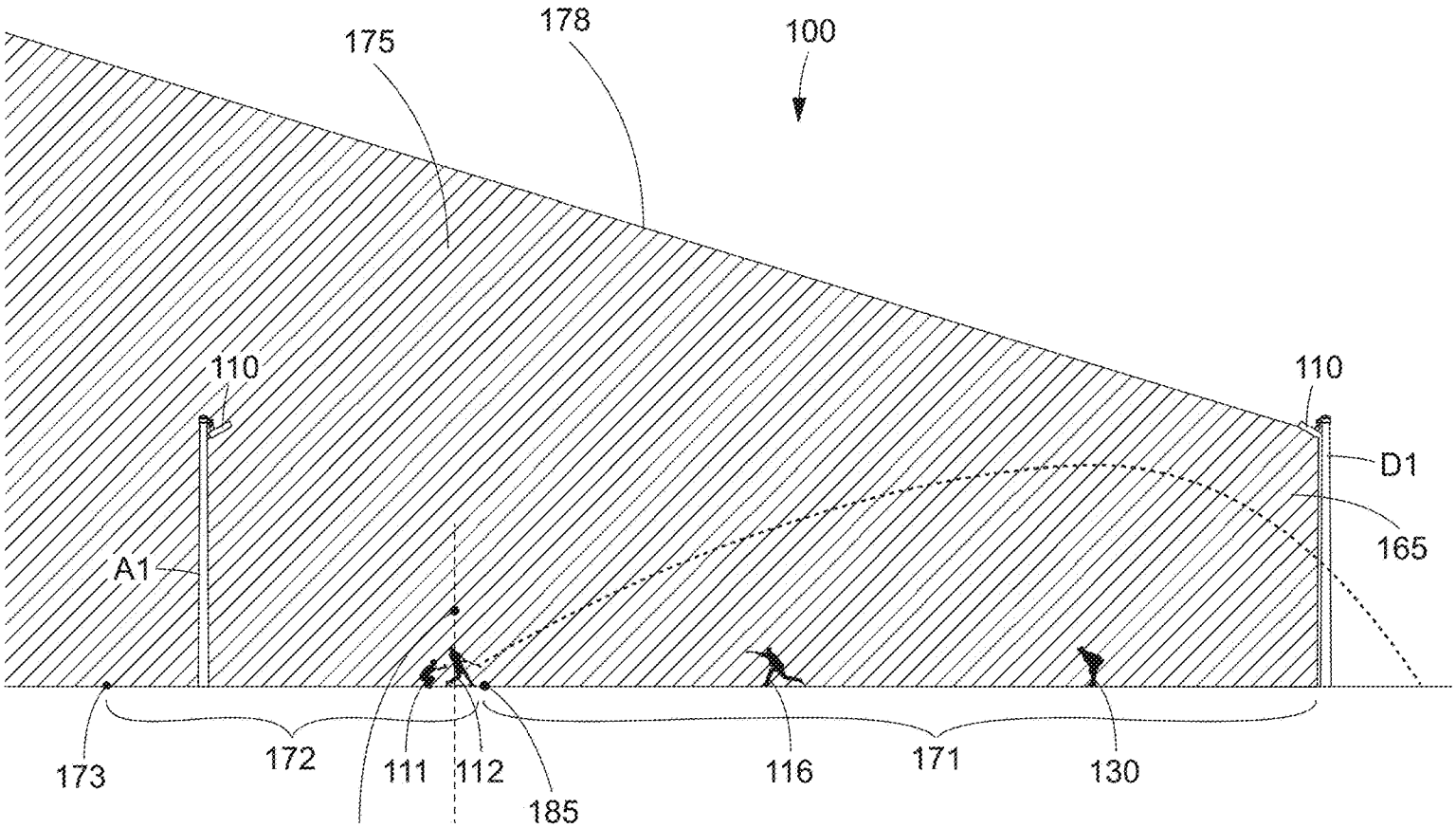
Prior Art Fig 2D

FIGS. 2C and 2D provide simplified views of lighting as perceived by fielder 140 and batter 112 respectively in accordance with existing art. In both cases, light from the poles most nearly aligned with players 140 and 112 is visible, and therefore potentially causing perceived glare, during normal play. In contrast, FIG. 2A depicts a side view of field 100 illuminated according to aspects of the invention, showing batter 112, catcher 111, pitcher 116, and right fielder 140. Line 180 shows a possible trajectory of a ball batted by batter 112. Light from LED array 120 mounted high on pole A1 illuminates the field at infield area 150. Said LED array comprises, in some fashion, directed light sources for upper and lower illumination patterns which are separated by an intermediate non-illuminated area, such that area 151, which includes the general area wherein right fielder 140 plays, is not illuminated by light from pole A1. (FIG. 1F illustrates such an LED array 120 or 121 which could in general provide a directed light source for upper and lower illumination patterns. Aforementioned U.S. patent application Ser. No. 15/782,039 further describes such a luminaire having a sharp cut off that would work well for embodiments as described herein.) Said illumination for aerial space 160 has a "horizontal cutoff" on the ground, shown at 166, FIG. 2A which is the limit of where the outfield would play near to the infield; this can be determined based on type of field, level of play, etc. Said illumination for aerial space 170 may have a "horizontal cutoff" either on the ground, shown at 164, FIG. 2A, or e.g. the outfield fence (or equivalent boundary) 153 may effectively provide cutoff at point 154, located some seven to ten or more feet above the ground (i.e. at a point that is above the heads of the outfielders at the fence). Note that line 155 indicates the "vertical curved plane" (i.e. the cylindrical section that would exist as a boundary if the outfield fence or barrier 153 were extended up through the aerial space requiring lighting) through the outfield which is the effective boundary of the area needing aerial light for playability.

Upper light from LED array 120 mounted high on pole A1 also illuminates the aerial space 170 above the field. Note that upper extent of illuminated space 170, as defined by line 179 may extend upward as shown, may be horizontal, or may be oriented downward, depending on such factors as pole height, local regulations, location of the field, etc. In between upper cutoff 162 of upper illumination pattern 170 which intersects with the field or ground at 164, and lower cutoff 161 of lower illumination pattern 160 which intersects with the field at 166, angular aerial space 163 is not illuminated by light from pole A1, though other light sources on the field (i.e. from the other poles) will normally provide sufficient light and contrast against the sky background for ball visibility and for playability in that aerial space. In this manner a baseball at point 177 in flight is adequately illuminated so to allow a player to visually track it—along its entire trajectory 180—in a manner that does not result in perceived glare by e.g. player 140 anywhere along said trajectory.

Figure 6:
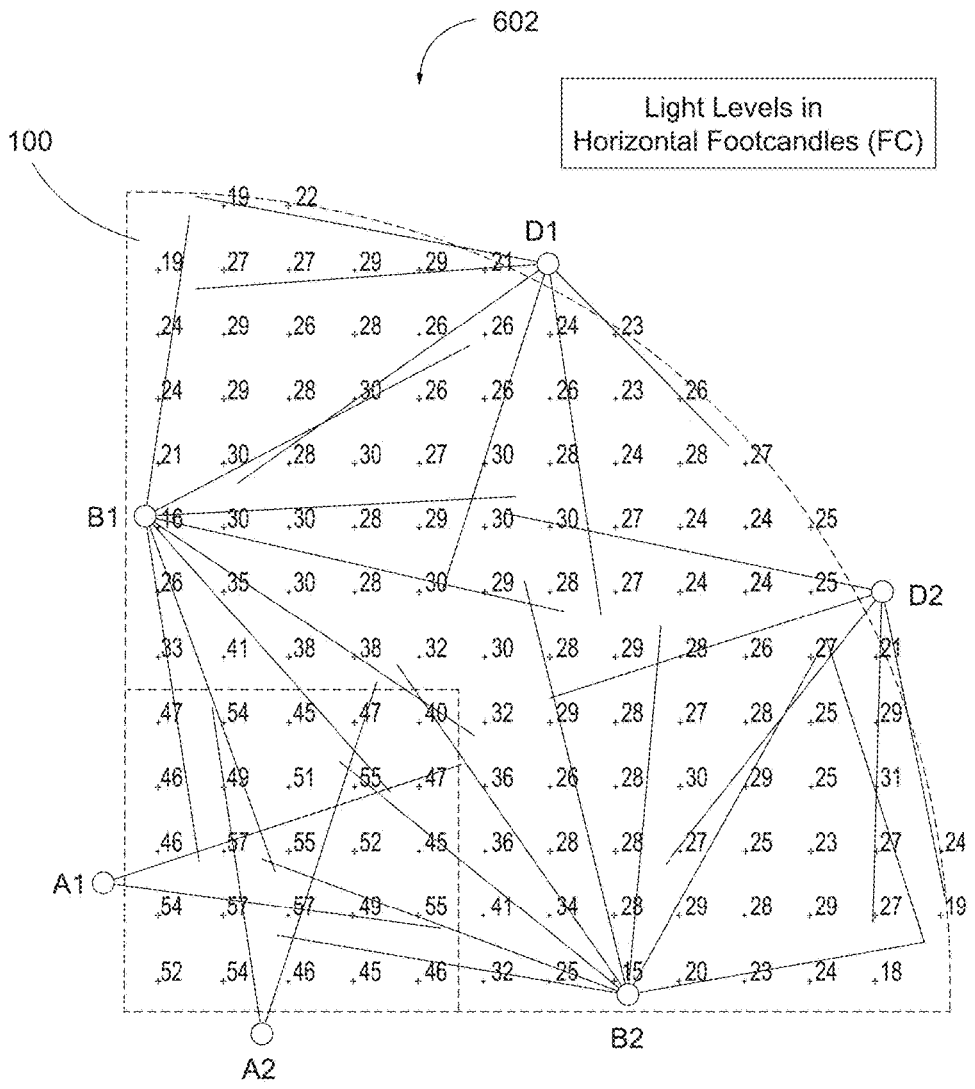
FIG. 6 illustrates an aiming diagram such as typically used in the art showing light levels at locations on the field and showing aiming locations for beam centers in accordance with the current invention.

Thus aerial spaces 160 and 170 are illuminated so that a ball in the air, hit by batter 112, is illuminated by light from pole A1 except in the aerial space 163 between cutoff lines 161 and 162, such as e.g. at point 177 between right fielder 140 and luminaire 120 on pole A1. Thus when the field is lit as described according to aspects of the invention, light from luminaire array 120 mounted on poles A1 is not visible to right fielder 140, and therefore glare perceived by the right fielder 140 is reduced or eliminated. FIG. 6 illustrates an aiming diagram showing light levels in horizontal foot-candles at locations on the field and showing aiming locations for beam centers in accordance with the current invention. It may be appreciated that the beam centers as shown indicate full lighting on the field, but using e.g. sharp cutoff luminaires as described in aforementioned U.S. patent application Ser. No. 15/782,039 instead of traditional luminaires, light is split above and below the aiming point and will be cut off as illustrated in FIGS. 2A-B and 3A-B and as discussed below.

As previously stated, though the ball in flight between cutoff lines 161 and 162 is not illuminated by light from pole A1 in the present embodiment, light from pole A2 and/or other poles provides sufficient illumination of the ball in flight for the right fielder to track the ball in its trajectory. Of course, this arrangement may be duplicated in mirror image for left fielder 130 and pole A2. This is illustrated in FIG. 2B which shows a plan view of the same system according to aspects of the invention. Light from LED luminaire arrays on poles A1 and A2, corresponding to field area 150 on FIG. 2A, is cut off horizontally just outside the infield at line 166, and resumes again, beginning at cutoff line 164 past outfield fence/boundary 153. (Note that the area between 153 and cutoff line 164 is ordinarily not considered as part of the playing area. Instead, cutoff line 164 provides a reference for the light in the aerial space above field areas 150 and 151 which is also above the intermediate zone 163, FIG. 2A.) Field area 151 receives little or no illumination from poles A1 and A2, which reduces or eliminates glare for the right fielder or left fielder from the A poles. The result is that light from the A poles that previously created glare for the right and left fielders and for center fielder 135, is shifted to prevent such a direct view by those players. Also, lighting from other poles or structures (see, e.g. fixtures 120, 121 FIG. 1F) are sufficient to ensure that that adequate light is still provided for illumination of the ball in the air and for general illumination for those players such that (apart from the reduction in glare for certain players) it is not generally perceptible to players or spectators that the lighting scheme is different from the current state of the art. Desired lighting levels will vary according to venue and may be adjusted in accordance with the current application. U.S. Pat. No. 9,402,292 provides a detailed discussion of lighting levels that are desirable for baseball fields.

Horizontal Cutoff Lighting for Batter

FIG. 3A further illustrates a method according to aspects of the invention that is designed to improve the visual situation of the batter or others in the home plate area. Line 180 shows a possible trajectory of a ball batted by batter 112. In accordance with the previously described method, a similar lighting zone with light supplied from LED luminaire array 120 on poles D1 and D2 is created. Note that for clarity, only the arrangement on pole D1 is illustrated; however in practice, this would be mirrored on pole D2 to provide the same benefits. Light which illuminates field area 171 also illuminates lower aerial space 165 which is cut off at 183 which intersects with the field at 185, before the batter's feet. Light which is cut off along a horizontal line at 173 and along lower cutoff 184 also illuminates upper aerial space 175, which can improve ball visibility or contrast compared to existing art by providing sufficient illumination from behind and outside of the fielder's ordinary view instead of the light that is provided by light sources according to existing art. Note that the upper extent of illuminated space 175, as defined by line 178 may extend upward as shown, may be horizontal, or may be oriented downward, depending on such factors as pole height, local regulations, location of the field, etc. The field area 172 which begins close to home plate and extends back therefrom (i.e. "away" from the outfield), corresponding to the angular aerial space 186, is not illuminated by the light from pole D1, and is intended to cut off some few or several feet above the batter's head at a height on the order of ten to twenty feet above the ground. Therefore, the actual LED light source or reflected or diffused light from LED array 120 on pole D1 is not directly viewable from within field zone 172 and the batter does not experience glare from pole D1. Again, a similar cutoff light arrangement is provided from pole D2 as a mirror image of the arrangement from pole D1, thereby further eliminating a potential source of glare.

Figure 3B:
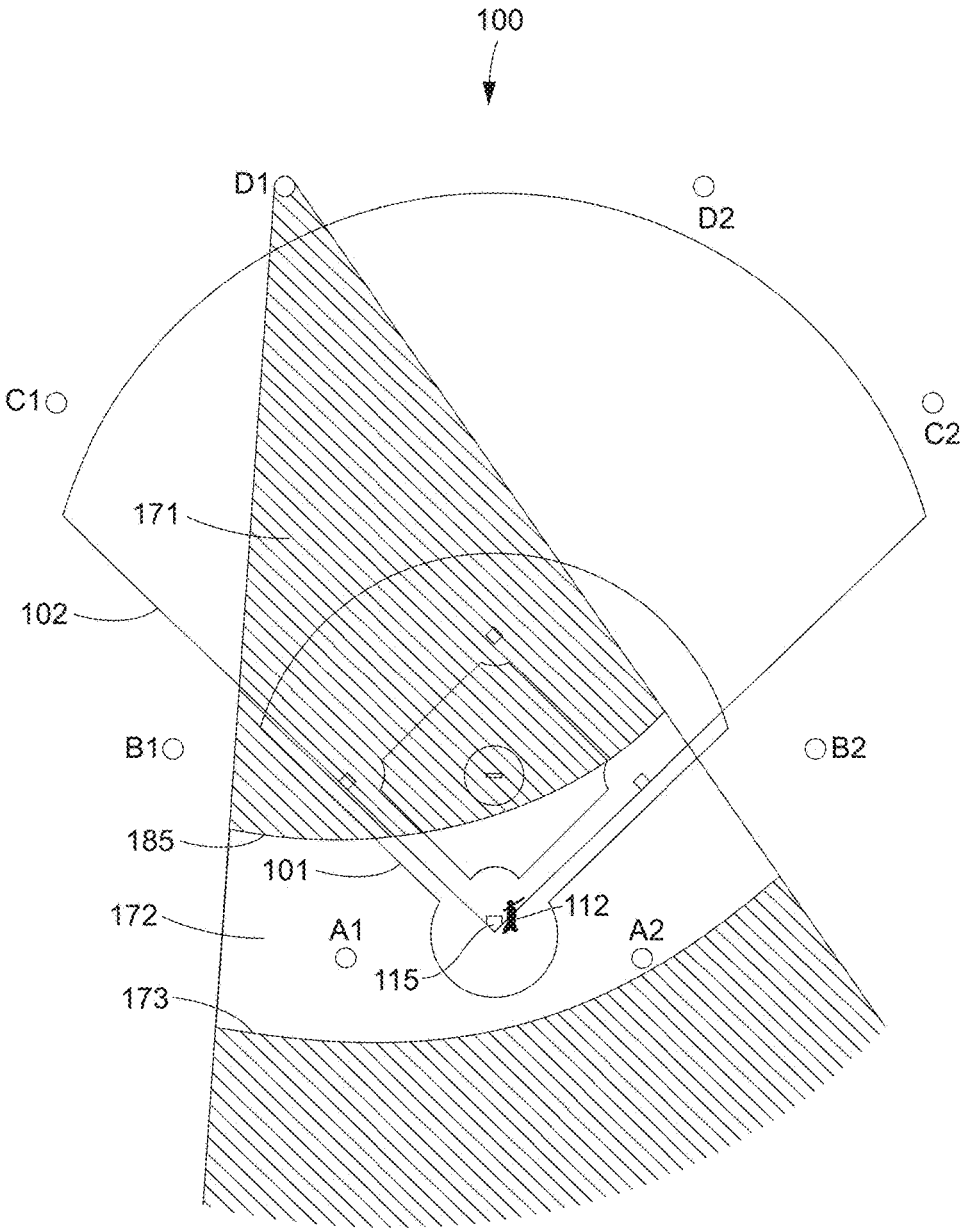

FIG. 3B shows an aerial view of the same system according to aspects of the invention. Light from LED luminaire arrays on pole D1 illuminates field area 171. Said LED array comprises, in some fashion, directed light sources for upper and lower illumination patterns which are separated by an intermediate non-illuminated area. Light from said array is cut off horizontally in front of the batter at line 185 corresponding to cutoff 183, FIG. 3A (i.e. at a location a few feet, on the order of 10-20 feet, in front of the batter) and resumes again in at line 173 which, along with its associated aerial space (i.e. 175 FIG. 3A), is illuminated. Field area 172 along with its associated aerial space (i.e. 186, FIG. 3A) receives little or no illumination from poles D1 and D2, which reduces or eliminates glare for the batter. Similarly for the batter as for the outfielders, the lower extent 184 of the upper illumination pattern 175 and therefore the effective horizontal cutoff 173, is intended to ensure that none of the upper lighting illuminates the batter, but rather cuts off a few feet above the batter's head at 176, on the order of ten to twenty feet above the ground.

Of course, light does not stop at line 173; rather line 173 illustrates the lower cutoff on the ground of the upper light directed from pole D1 in the direction of home plate. Structures such as viewer stands behind the batter have been omitted from the drawings but would be illuminated to some extent by that upper light from pole D1 (which, in some cases, can be desirable for e.g., television broadcasting). It should be understood that this is not necessarily additional light caused by the use of the methods disclosed herein, but is merely light that would already be present in fields illuminated according to existing art by luminaires high on a pole that are providing uplighting for the field. It should also be noted that despite any potential illumination of the first few rows of spectator seating, the present invention is still an improvement over existing art insomuch that the perceived glare for players (i.e., onsite glare) is reduced.

The exact extent of cutoff line 173 will vary depending on height of outfield poles and their distance from home plate. The result is that light from the D poles as discussed (or e.g. from other poles, structures, or mounting locations similarly situated, whether from lighting plans having eight or more or fewer mounting poles, structures, or mounting locations), that formerly created glare for the batter, is shifted to prevent such a direct view. As envisioned, existing lighting from other poles or structures is sufficient to ensure that that adequate light is still provided for illumination of the ball in the air and for general illumination for those players such that (apart from the reduction in glare for certain players) it is not generally perceptible to players or spectators that the lighting scheme is different from the current state of the art.

C. Exemplary Embodiment 1—Vertical Cutoff

An embodiment according to aspects of the invention comprises a method for lighting a sports field to an accepted or desired standard for illumination by providing a lighting design comprising directed light sources which provide a cutoff of visibility of the light sources, along one or two more-or-less vertical planes which intersect the playing field such that light is provided on a portion of the field but is cut off from the area of the field where the fielder is, and wherein the illumination is provided from an array of LEDs mounted at or near the top of a pole or equivalent mounting structure such as e.g. 120 or 121, FIG. 1F, at a height of tens of feet, typically on the order of 70-120 feet. Said illumination pattern comprises light directed to a target area on the field and which also illuminates a particular aerial zone above said target area but not the area in which a certain player ordinarily plays and reduces or eliminates glare from the light source for the player, while still providing lighting for said sports field to said accepted standard for illumination.

Vertical Cutoff Lighting for Outfielders

FIG. 4A illustrates a method for lighting according to aspects of the invention, using a vertical cutoff from pole A1. Light may be applied to the entirety of area 191 on the field, but is cut off vertically at 193 such that right fielder 140 and the field area 192 are not illumined by light from pole A1. Thus the right fielder looking directly or close to directly at pole A1 while tracking a ball hit high in the air does not experience the glare that typically results from light from pole A1. The right fielder is still illumined by light (not shown) from pole A2, but the angle is sufficiently removed from the trajectory of a ball hit into left field that the glare from pole A2 is minimal. Thus aerial illumination of the ball from pole A2 is still provided, but this lighting is not a source of significant glare from pole A2 for the right fielder attempting to track the ball. A similar arrangement (identical, but in mirror image) is made for vertical cutoff of light from pole A2 for the benefit of left fielder 130, who is thus likewise shielded from glare from pole A2. In this way light from poles A1 and A2 still provides illumination for the outfield, while significantly reducing glare to the left and right fielders.

Vertical Cutoff Lighting for Batter

FIG. 4B shows a similar vertical cutoff of lighting for the benefit of batter 112 at home plate. Light from pole D2 is cut off vertically at 188 and/or 189 such that one or both of areas 181 and 182 are illuminated, providing both field and aerial illumination, but the batter 112 in area 187 is shielded from direct viewing of the light sources of the LED arrays 120 on pole D2. Of course this may be duplicated or mirrored with regard to pole D1 or other light sources as applicable to further reduce glare perceived by the batter.

D. Exemplary Embodiment 1—Reducing Glare

Figure 5:
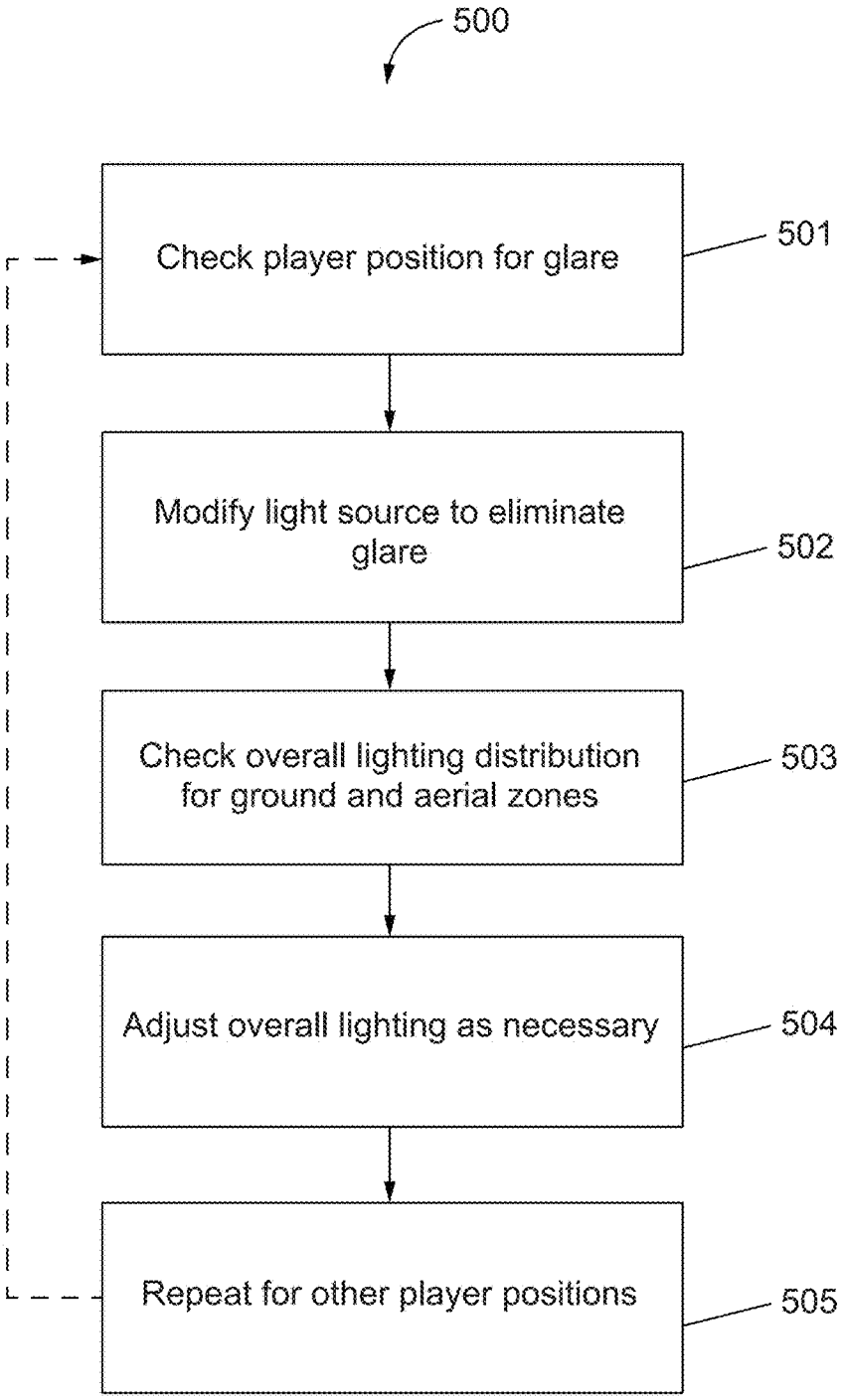
FIG. 5 is a flow chart illustrating one possible method according to aspects of the invention.

FIG. 5 illustrates a flow chart describing a method 500 according to aspects of the invention for reducing glare for players. According to step 501, a player position such as e.g. left fielder 130 (FIG. 2B) is analyzed for potential glare based on the activity of the player with regard to potential glare sources which could include e.g. poles A1, A2, B1, and B2 (FIG. 1C). In step 502, an identified potential source of glare such as pole A2 has its aiming, visoring, or other factors modified to eliminate glare by shielding the player from direct view of the light source. In step 503, the lighting distribution for ground and aerial spaces (such as shown for example in aiming diagram 602, FIG. 6 for baseball field 100 and in diagram 30C, FIG. 7 for uplight, respectively) is checked to determine if adequate lighting remains from other sources at other angles which are less likely to cause glare. If necessary, in step 504 lighting sources such as e.g. at poles A1 and B2 are readjusted and/or added to maintain adequate lighting according to accepted standards. In step 505, the process is repeated for other player positions such as e.g. right fielder 140 or batter 112 (FIG. 1C) as desired and lighting is adjusted where practicable or desired. Note that in the diagram of FIG. 6, due to the ability to reduce or eliminate perceived glare for certain player positions while still providing adequate light, pole locations C1 and C2 have been omitted. Other pole configurations and positions are possible and are envisioned.

In practice, a method such as that illustrated in FIG. 5 may be implemented as follows. On a standard baseball field, a layout of eight spaced apart poles may be used with a variety of luminaires mounted therefrom at roughly a height of 70 feet; of course, as described earlier, at least some luminaires might be mounted on elevating structures (e.g., trusses) above or behind spectator seating in addition to or in lieu of using poles. According to aspects of the present invention, each luminaire has both vertical and horizontal aiming capabilities relative the plane of the field such that may be aimed so to collectively produce a composite beam pattern of desired uniformity and intensity; this could be in accordance with aforementioned co-pending U.S. patent application Ser. No. 15/782,039 (FIG. 8), provisional U.S. Patent Application Ser. No. 62/515,832 hereby incorporated by reference in its entirety (FIG. 9), or otherwise. Aiming angles on average for baseball fields range from 21-25 degrees (from horizon), but more specific aiming recommendations are laid out in the aforementioned RP-6-15 lighting standard. According to method 500, a first step 501 comprises checking player position for glare. In practice, it is likely that already lit baseball fields (i.e. lit according to state-of-the-art practices) would be evaluated to determine actual onsite glare issues for different player positions. That knowledge would then be used to evaluate potential onsite glare issues within the lighting design software (i.e. the software commonly used to generate aiming diagrams such as in FIG. 6). As illustrated herein, potential onsite glare issues would likely arise any time an anticipated ball trajectory crosses directly in front of a luminaire in the line-of-sight of a player; potential onsite glare issues would also likely arise when a light source of a luminaire could be directly seen by a player when said player was looking along common lines-of-sight for that player position; however, while these are the most common glare issues, others are possible.

Once potential onsite glare issues are identified, light sources may be modified to eliminate said potential onsite glare according to step 502. The lighting design (see again FIG. 6) would likely be modified—aiming points adjusted, aiming points moved to different mounting locations, or both. In practice this might correspond to changing aiming angle of a visor or other component of a lighting fixture, moving lighting fixtures to different points on the same pole (compare, for example, the position of fixture 109, FIG. 1E to that of fixture 121, FIG. 1F), or moving lighting fixtures to different poles (which could change an eight-pole design to a six-pole design, for example (see FIG. 6)). Some specific examples for horizontal cutoff (FIG. 8) could include adjusting the angle of adjustable armatures 122 relative their connection point to a crossarm 123 for fixtures 121 higher in the array, fixtures 120 lower in the array, or both. Some specific examples for vertical cutoff (FIG. 9) could include pivoting adjustable armatures 122 relative their connection point to a crossarm 123 for right fixture 120, left fixture 121, both right and left fixtures (120, 121), or even pivoting of pole 113 relative its mounting position at the ground.

It is important to note that this step (and subsequent steps 503-505) require a number of things: a lighting fixture capable of at least some of the aforementioned, photometry from said lighting fixture loaded into the lighting design software so to predict or determine light levels at various aiming positions, evaluation of the entire lighting design (not just the area where re-aiming is occurring) to ensure lighting uniformity, and expansion of what is being evaluated (i.e. considering now in 3D a target area that was previously only evaluated according to state-of-the-art practices in 2D). As such, it should be understood that FIG. 5 illustrates a simplified version of what in reality is a complicated and iterative process. For example, as was illustrated in FIG. 1F, it is possible to mount some number of LED lighting fixtures 120 high on a pole and aimed generally downward or horizontally to provide lower illumination patterns 160 (FIG. 2A); likewise, some number of LED lighting fixtures 121 might be mounted high on a pole and aimed slightly upward or horizontally to provide upper illumination patterns 170 (FIG. 2A). This assumes that pole 113 can withstand wind loads and general weight requirements of what is essentially doubling the number fixtures over prior art (i.e. FIG. 1E). While this could provide a benefit of removing some poles from the lighting design, increasing the load on remaining poles may simply not be achievable in situations where poles are already set (e.g. retrofit situations). As such, a lighting designer may need to expand method 500 of FIG. 5 to include different means of modifying a light source (step 502) so to keep the overall fixture count per pole the same—this might include adjustment of reflective components internal to the lighting fixture, adjusting armatures which affix the lighting fixture to the pole, modifying the optics of the lighting fixture to provide a split beam from a single fixture (i.e., one or more fixtures lighting both upper and lower illumination patterns), etc.

E. Options and Alternatives

It should be understood that some or all of the methods described herein may be applied in accordance with design specifications for the field and other factors such as cost or level of play (e.g. high school, college, or professional play), and therefore could vary. Some embodiments according to aspects of the invention are particularly appropriate for professional or semi-professional baseball, such as major league baseball, minor league baseball, or other venues having large spectator seating areas which typically preclude the use of lighting poles or other mounting structures which are between spectators and the playing field such as would be required for low-mounted uplights. Some methods may be more adapted for a field intended for low cost and limited playing time or limited playing ability. Other fields which are less concerned with cost but highly sensitive to the need for glare control and for excellent playability may be more suited for others of the methods described herein. As one specific example, in embodiments using horizontal cutoff, providing lower lighting such as 160, FIG. 2A, or 165, FIG. 3A may be sufficient for a given location, particularly since lighting for the upper lighting areas 170 FIG. 2A and 175 FIG. 3A may not be needed.

It should be further noted that pole placement patterns using more or fewer poles than those discussed or illustrated herein (e.g., as may be used for a lower speed, lower skill level baseball or softball game) or other mounting structures (e.g., trusses) or locations may be used and are considered within the scope of the invention. Further, while baseball fields have been described, softball fields or other sports venues—especially those having particular player positions—are envisioned as within the scope of the invention as well. Finally, methods described herein could be applied to any lighting design requiring uplighting, whether or not a sports lighting application. For example, aspects according to the present invention could be applied to an indoor lighting application wherein uplight is needed to adequately highlight something stationary (i.e., not in flight) near the ceiling or generally away from the floor (e.g., a platform).

What is claimed is:

1. A method of lighting a sports field including a plane and an aerial space proximate the plane comprising:

a. illuminating the plane to a first defined light level with a first plurality of aimable light sources mounted to elevating structures at spaced apart positions at or near the top of the elevating structures;

b. illuminating the aerial space to a second defined light level with a second plurality of aimable light sources mounted to said elevating structures at or near the top of the elevating structures;

c. identifying one or more factors associated with the sports field which could impact perceived glare of one or more players, said factors comprising any of:

i. trajectory of a ball or other object in flight;

ii. illumination of a ball or other object in flight; or iii. lines-of-sight of said players; and d. cutting off light from said first and second plurality of light sources relative one or more player positions based, at least in part, on said identified factors.

2. The method of claim 1 wherein the first plurality of aimable light sources are contained in a first array of one or more luminaires and wherein the second plurality of aimable light sources are contained in a second array of one or more luminaires.

3. The method of claim 2 wherein the first and second arrays of luminaires are mounted to the same elevating structure.

4. The method of claim 3 wherein the sports field comprises a baseball field, and wherein the elevating structures are spaced apart such that there are six elevating structure spaced about the baseball field.

5. The method of claim 1 wherein the first defined light level is higher than the second defined light level.

6. The method of claim 5 wherein the first defined light level is defined at a point on the plane, and wherein the second defined light level is defined at a point in the aerial space at least tens of feet away from the defined point on the plane.

7. The method of claim 1 wherein at least some of the first plurality of aimable light sources and at least some of the second plurality of aimable light sources are contained in the same luminaire.

8. A method of improved aerial lighting of a lit sports field comprising:

a. identifying one or more factors associated with the sports field which could impact perceived glare of one or more players, said factors comprising any of:

i. trajectory of a ball or other object in flight;

ii. illumination of a ball or other object in flight; or iii. lines-of-sight of said players;

b. identifying one or more elevated light sources which provide lighting of the sports field from at or near the top of a pole or mounting structure and impact perceived glare based, at least in part, on said one or more factors;

c. adjusting the one or more identified light sources to reduce perceived glare while still providing aerial lighting from the elevated position;

d. so that the sports field remains lit and an aerial space above or near the sports field is also lit from the elevated position without producing perceived glare by players.

9. The method of claim 8 wherein the step of identifying one or more light sources which provide lighting of the sports field from at or near the top of a pole or mounting structure and impact perceived glare comprises identifying one or more light fixtures closest to a line-of-sight of a player, and wherein the method further comprises cutting light off before reaching the line-of-sight.

10. The method of claim 9 wherein the step of cutting light off before reaching a player line-of-sight comprises directing a portion of light downward and before the line-of-sight, and directing a portion of light upward and after the line-of-sight, such that a perceived glare source is not directly viewable at the line-of-sight.

11. The method of claim 10 wherein the directing a portion of light upward and after the line-of-sight comprises adjusting one or more of a visor or an adjustable armature associated with said one or more light fixtures.

12. The method of claim 10 applied to a baseball field, and wherein the line-of-sight is defined for a player on the field.

13. The method of claim 9 wherein the step of cutting light off before reaching a player line-of-sight comprises directing a portion of light to one side of the line-of-sight, and directing a portion of light to another side of the line-of-sight, such that a perceived glare source is not directly viewable at the line-of-sight.

14. The method of claim 13 wherein the directing a portion of light of the line-of-sight comprises pivoting one or more of a pole or an adjustable armature associated with said one or more light fixtures.

15. The method of claim 14 applied to a baseball field, and wherein the line-of-sight is defined for a player on the field.

16. The method of claim 8 wherein the sports field is lit to a different illumination level than an aerial space above or near the sports field.

17. A method of reducing perceived glare in baseball or softball lighting comprising:

a. defining common lines-of-sight for a player position;

b. defining one or more trajectories of a ball in flight; and c. designing a lighting system to illuminate a field of play including a 3D space containing the one or more trajectories comprising:

i. illuminating the field of play to a first defined light level from an elevated position with one or more lighting fixtures spaced around the field of play at elevated positions;

ii. illuminating the 3D space to a second defined light level from an elevated position with the one or more lighting fixtures spaced around the field of play at elevated positions; and iii. cutting off light from any lighting fixture which produces perceived glare at the player position along the common lines-of-sight or trajectories of a ball in flight.

18. The method of claim 17 wherein the first defined light level is higher than the second defined light level.

19. The method of claim 18 wherein the first defined light level is defined at a point on the field of play, and wherein the second defined light level is defined at a point in the 3D space at least tens of feet away from the defined point on the field of play.

20. The method of claim 17 applied to a plurality of player positions.

* * * * *